US007635114B2

(12) United States Patent
Laws et al.

(10) Patent No.: US 7,635,114 B2
(45) Date of Patent: Dec. 22, 2009

(54) ROTATIONALLY MOLDED, REINFORCED DECORATIVE FENCE POST AND METHOD OF MAKING SAME

(75) Inventors: David J. Laws, Provo, UT (US); R. Dru Laws, Pleasant Grove, UT (US); Livingston Elwood Atkins, III, Orem, UT (US); Phillip Swindler, Provo, UT (US); Kip M. Colton, Eagle Mountain, UT (US); Nikki Colton, legal representative, Eagle Mountain, UT (US)

(73) Assignee: MFS, LLC, Orem, UT (US)

( * ) Notice: Subject to any disclaimer, the term of this patent is extended or adjusted under 35 U.S.C. 154(b) by 202 days.

(21) Appl. No.: 11/604,185

(22) Filed: Nov. 22, 2006

(65) Prior Publication Data

US 2007/0158629 A1 Jul. 12, 2007

Related U.S. Application Data

(63) Continuation-in-part of application No. 11/256,216, filed on Oct. 21, 2005, and a continuation-in-part of application No. 10/464,622, filed on Jun. 18, 2003, now abandoned, application No. 11/604,185, which is a continuation-in-part of application No. 11/009,186, filed on Dec. 10, 2004, now abandoned, application No. 11/604,185, which is a continuation-in-part of application No. 11/003,709, filed on Dec. 3, 2004, now abandoned.

(60) Provisional application No. 60/389,855, filed on Jun. 18, 2002, provisional application No. 60/529,006, filed on Dec. 12, 2003, provisional application No. 60/529,007, filed on Dec. 12, 2003.

(51) Int. Cl.

| | |
|---|---|
| ***E04H 17/20*** | (2006.01) |
| *E04H 17/14* | (2006.01) |
| *E04H 17/16* | (2006.01) |

(52) U.S. Cl. ..... 256/19; 256/73; 264/40.7; 264/46.5; 52/309.7; 52/309.16; 52/837; 52/846

(58) Field of Classification Search ..... 256/1, 256/19, 65.14, 73; 296/187.02; 52/167.3, 52/167.7, 169.13, 309.7, 309.16, 837, 846; 264/40.7, 46.5; 428/122

See application file for complete search history.

(56) References Cited

U.S. PATENT DOCUMENTS 1,876,336 A 9/1932 McLaughlin (Continued)

FOREIGN PATENT DOCUMENTS

AU 486419 * 3/1973

OTHER PUBLICATIONS

Product Specifications for GenStone, See Website—http://www.genstoneproducts.com/simulated-rock-stone-brick-specs.cfm, printed Feb. 17, 2006, pp. 1-3.

(Continued)

*Primary Examiner*—Daniel P Stodola
*Assistant Examiner*—Ernesto Garcia
(74) *Attorney, Agent, or Firm*—Thorpe North & Western LLP

(57) ABSTRACT

A decorative post includes an elongated outer polymer shell having at least one longitudinal groove extending a majority of a length of the elongated shell sized and shaped to hold a decorative fence panel. The decorative fence post also includes an elongated reinforcing member disposed in the outer polymer shell, and substantially extending a length of the fence post. A foam filler is disposed inside the outer polymer shell between the shell and the reinforcement member. An aperture is disposed in the outer polymer shell near an end of the reinforcing member, and a void extends from the aperture into the foam filler adjacent to and exposing an end of the reinforcing member. The void defines a slip zone at the end of the reinforcing member into which the reinforcing member extends as the outer shell shrinks longitudinally during post mold cooling.

7 Claims, 17 Drawing Sheets

U.S. PATENT DOCUMENTS

| | | | | | |
|---|---|---|---|---|---|
| 2,996,764 | A | | 8/1961 | Ross et al. | |
| 3,150,032 | A | | 9/1964 | Rubenstein | |
| 3,158,236 | A | * | 11/1964 | Caligiuri | |
| 3,223,056 | A | | 12/1965 | Wilburn | |
| 3,254,464 | A | | 6/1966 | Hoyt, Jr. | |
| 3,298,894 | A | | 1/1967 | Barnette | |
| 3,309,051 | A | | 3/1967 | Pina | |
| 3,328,500 | A | | 6/1967 | Barnette | |
| 3,337,662 | A | | 8/1967 | Spencer | |
| 3,516,213 | A | * | 6/1970 | Sauer | 52/834 |
| 3,761,554 | A | | 9/1973 | Barnette | |
| 3,832,264 | A | | 8/1974 | Barnette | |
| 3,856,451 | A | | 12/1974 | Holzinger | |
| 3,875,275 | A | | 4/1975 | Lemelson | |
| 3,880,092 | A | | 4/1975 | Seeber et al. | |
| 3,880,097 | A | | 4/1975 | Camilleri | |
| 3,962,390 | A | | 6/1976 | Mori et al. | |
| 4,019,301 | A | * | 4/1977 | Fox | 52/834 |
| 4,043,278 | A | | 8/1977 | Kessler et al. | |
| 4,271,108 | A | | 6/1981 | Reffelmann | |
| 4,560,523 | A | | 12/1985 | Plumley et al. | |
| 4,671,753 | A | | 6/1987 | Payne | |
| 4,676,041 | A | | 6/1987 | Ford | |
| 4,705,101 | A | | 11/1987 | Warner | |
| 4,749,533 | A | | 6/1988 | Payne | |
| 5,011,636 | A | | 4/1991 | Payne | |
| 5,078,367 | A | | 1/1992 | Simpson et al. | |
| 5,141,327 | A | | 8/1992 | Shiobara | |
| 5,245,733 | A | | 9/1993 | Goria | |
| 5,268,400 | A | | 12/1993 | Iseler et al. | |
| 5,269,991 | A | | 12/1993 | Gueret | |
| 5,271,338 | A | | 12/1993 | Bonham | |
| 5,321,873 | A | | 6/1994 | Goria | |
| 5,366,675 | A | | 11/1994 | Needham | |
| 5,374,180 | A | | 12/1994 | Bauer | |
| 5,389,316 | A | | 2/1995 | Kerman | |
| 5,394,808 | A | | 3/1995 | Dutro et al. | |
| 5,532,282 | A | | 7/1996 | Needham | |
| 5,638,762 | A | | 6/1997 | Chestnutt | |
| 5,693,271 | A | | 12/1997 | Johnson et al. | |
| 5,702,090 | A | | 12/1997 | Edgman | |
| 5,759,472 | A | | 6/1998 | DeFranco et al. | |
| 5,783,611 | A | | 7/1998 | Strebel | |
| 5,845,588 | A | | 12/1998 | Gronnevik | |
| 5,876,262 | A | | 3/1999 | Kelly et al. | |
| 5,911,927 | A | | 6/1999 | Roberts | |
| 5,928,584 | A | | 7/1999 | Lee et al. | |
| 5,947,037 | A | | 9/1999 | Hornberger et al. | |
| 6,024,903 | A | | 2/2000 | Naft et al. | |
| 6,083,434 | A | | 7/2000 | Strebel | |
| 6,096,403 | A | * | 8/2000 | Wycech | 296/187.02 |
| 6,180,203 | B1 | | 1/2001 | Unkles | |
| 6,245,266 | B1 | | 6/2001 | Ramesh | |
| 6,261,490 | B1 | | 7/2001 | Kliene | |
| 6,267,410 | B1 | | 7/2001 | Koketsu et al. | |
| 6,334,504 | B1 | | 1/2002 | Sato et al. | |
| 6,345,809 | B1 | | 2/2002 | Bebendorf | |
| 6,361,848 | B1 | | 3/2002 | Katsube et al. | |
| 6,368,538 | B1 | | 4/2002 | Kitterman | |
| 6,383,437 | B1 | | 5/2002 | Grieve | |
| 6,505,454 | B2 | * | 1/2003 | Dingler | 52/834 |
| 6,637,728 | B2 | | 10/2003 | Pettit et al. | |
| 6,659,021 | B2 | | 12/2003 | Wen | |
| 6,694,897 | B2 | | 2/2004 | Lou-Hao | |
| 6,719,277 | B2 | | 4/2004 | Ohanesian | |
| 6,726,864 | B2 | | 4/2004 | Nasr et al. | |
| 6,814,374 | B2 | * | 11/2004 | Riefe | 280/779 |
| 6,944,998 | B1 | | 9/2005 | King | |
| 7,011,779 | B2 | | 3/2006 | Fernandes | |
| 7,305,799 | B2 | * | 12/2007 | Smelser et al. | 52/167.3 |
| 7,478,797 | B2 | * | 1/2009 | Laws et al. | 256/19 |
| 2002/0000545 | A1 | | 1/2002 | Pettit et al. | |
| 2002/0145229 | A1 | | 10/2002 | Kuriger et al. | |
| 2002/0177028 | A1 | | 11/2002 | Suzuki et al. | |
| 2003/0121459 | A1 | | 7/2003 | Lou-Hao | |
| 2003/0233967 | A1 | | 12/2003 | Lin | |
| 2004/0045488 | A1 | | 3/2004 | Danzik et al. | |
| 2005/0087908 | A1 | | 4/2005 | Nasr et al. | |
| 2006/0081160 | A1 | | 4/2006 | Wang | |

OTHER PUBLICATIONS

Application and Uses for GenStone, See Website—http://www.genstoneproducts.com/applications-uses.cfm, printed Feb. 17, 2006, pp. 1-2.

Cultured Stone Manufactured Stone Veneer, See Website—http://www.culturedstone.com/index.asp, printed Feb. 17, 2006, pp. 1-2.

Advanced Rock Technologies, See Website homepage—http://www.advancedrock.net, printed Feb. 17, 2006, pp. 1-2.

Advanced Rock Technologies, Rocky Mountain Cut Sandstone Panels, See Website—http://www.advancedrock.net/RockyStone.asp?, printed Feb. 17, 2006, pp. 1-3.

Advanced Rock Technologies, Old Schoolhouse Brick Panels, See Website—http://www.advancedrock.net/oldbrick.asp?, printed Feb. 17, 2006, pp. 1-3.

Hoover Fence Company, Decorative Vinyl rock Posts/Columns, See Website—http://www.hooverfence.com/vinyl/columns/columns.htm, printed Feb. 17, 2006, pp. 1-2.

"What is Rotational Molding?", Goria Corporation literature, See Website—http://www.goriacorp.com/plastic.htm, printed Mar. 13, 2006, pp. 1-2.

Literature from Advanced Rock Technologies, LLC of Golden, Colorado, "Rocky Mountain Cut Sandstone Panel," pp. 1-2.

Literature from Tuftek Composites, "Stonehenge," Privacy and Stone Walls, printed Feb. 1, 2004, pp. 1-21.

* cited by examiner

ROTATIONALLY MOLDED, REINFORCED DECORATIVE FENCE POST AND METHOD OF MAKING SAME

PRIORITY CLAIM

This is a continuation-in-part of U.S. patent application Ser. No. 11/256,216 filed on Oct. 21, 2005; U.S. patent application Ser. No. 10/464,622 filed on Jun. 18, 2003 now abandoned, which claims priority from U.S. Provisional Patent Application Ser. No. 60/389,855, filed on Jun. 18, 2002; U.S. patent application Ser. No. 11/009,186, filed Dec. 10, 2004 now abandoned, which claims priority from U.S. Provisional Patent Application Ser. No. 60/529,006, filed on Dec. 12, 2003; and U.S. patent application Ser. No. 11/003,709 filed on Dec. 3, 2004 now abandoned which claims priority from U.S. Provisional Patent Application Ser. No. 60/529,007, filed on Dec. 12, 2003; which are herein incorporated by reference.

BACKGROUND

Fences are commonly used to delineate borders between homes or lots. There are many types of fences and fencing materials that are used in residential fencing, such as chain link, wood, vinyl, rock, stone, brick, and concrete.

Chain link fences are considered by many to be aesthetically unattractive and easily damaged. Furthermore, damaged chain link is difficult to fix or replace since either the entire length of chain link fabric must be replaced, or the damaged area must be removed and a new section knitted into the existing undamaged fence. In either case, the repair is not easily accomplished and often results in a less attractive fence.

Many consider wood fences to be more attractive than chain link. However, wood can quickly deteriorate from exposure to the weather. Consequently, wood fences can be high maintenance and must be painted or oiled in order to retain aesthetically pleasing attributes.

Vinyl fences are preferred by some, and can require less maintenance than wood fences. However, vinyl fencing is relatively brittle and weak, and therefore can be easily damaged. Additionally, damaged vinyl fencing is not easily repaired or replaced, and often requires removal and replacement of fence posts to repair even a single slat.

Rock, stone and brick fences can be attractive, long lasting, low maintenance, and can have high strength. However, masonry products are expensive when compared to other fencing materials. Additionally, such fences are not easily repaired when damaged.

Some fences are made of concrete that has been molded and shaped to look like rock or stone fences. Concrete fences and walls are difficult and costly to install. Additionally, concrete fences can be expensive and difficult to repair or replace.

Molded fences have been made from polymeric materials that simulate other fencing materials such as rock or stone. Such molded fencing, however, has problems with warping due to thermal differentials on opposite sides of the fence. In addition, such molded fencing often uses complicated molding processes to achieve sand and/or color on the surface of the fence, which can be easily marred, leaving an unattractive surface that is difficult to repair or replace.

SUMMARY OF THE INVENTION

It has been recognized that it would be advantageous to develop a molded decorative fence post with a reinforcing member that does not deform during cooling or during use in daily atmospheric heating and cooling cycles. It has also been recognized that it would be advantageous to develop a method for making a molded decorative fence post with a reinforcing member in a single pass mold operation that does not induce significant internal stresses in the fence post during post mold cooling.

The invention provides a decorative post configured to be disposed in a support surface to support a decorative fence or wall panel. The decorative fence post can include an elongated outer polymer shell having at least one longitudinal groove extending a majority of a length of the elongated shell. The at least one longitudinal groove can be sized and shaped to hold a decorative fence panel. The decorative fence post can also include an elongated reinforcing member disposed in the outer polymer shell, and substantially extending a length of the fence post. A foam filler can be disposed inside the outer polymer shell between the shell and the reinforcement member. An aperture can be disposed in the outer polymer shell near an end of the reinforcing member, and a void can extend from the aperture into the foam filler adjacent to and exposing an end of the reinforcing member. The void can define a slip zone at the end of the reinforcing member into which the reinforcing member can extend as the outer shell shrinks longitudinally during post mold cooling.

The present invention also provides for a method for making a fence post including placing an elongate reinforcing member in a mold. An outer polymer shell can be formed around the elongate reinforcing member in the mold. The mold can form at least one longitudinal groove in the outer shell that can hold a section of fence, or an end of a decorative fence panel. The mold can also form an aperture in a lower end of the outer shell corresponding to an end of the elongate reinforcing member. The outer polymer shell can be filled with a foam filler material that can substantially surround the elongate reinforcing member. A void can be formed in the foam core between the aperture in the outer polymer shell and the end of the elongate reinforcing member to define a slip zone around the end of the elongate reinforcing member.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

DETAILED DESCRIPTION OF EXAMPLE EMBODIMENT(S)

Figure 1:
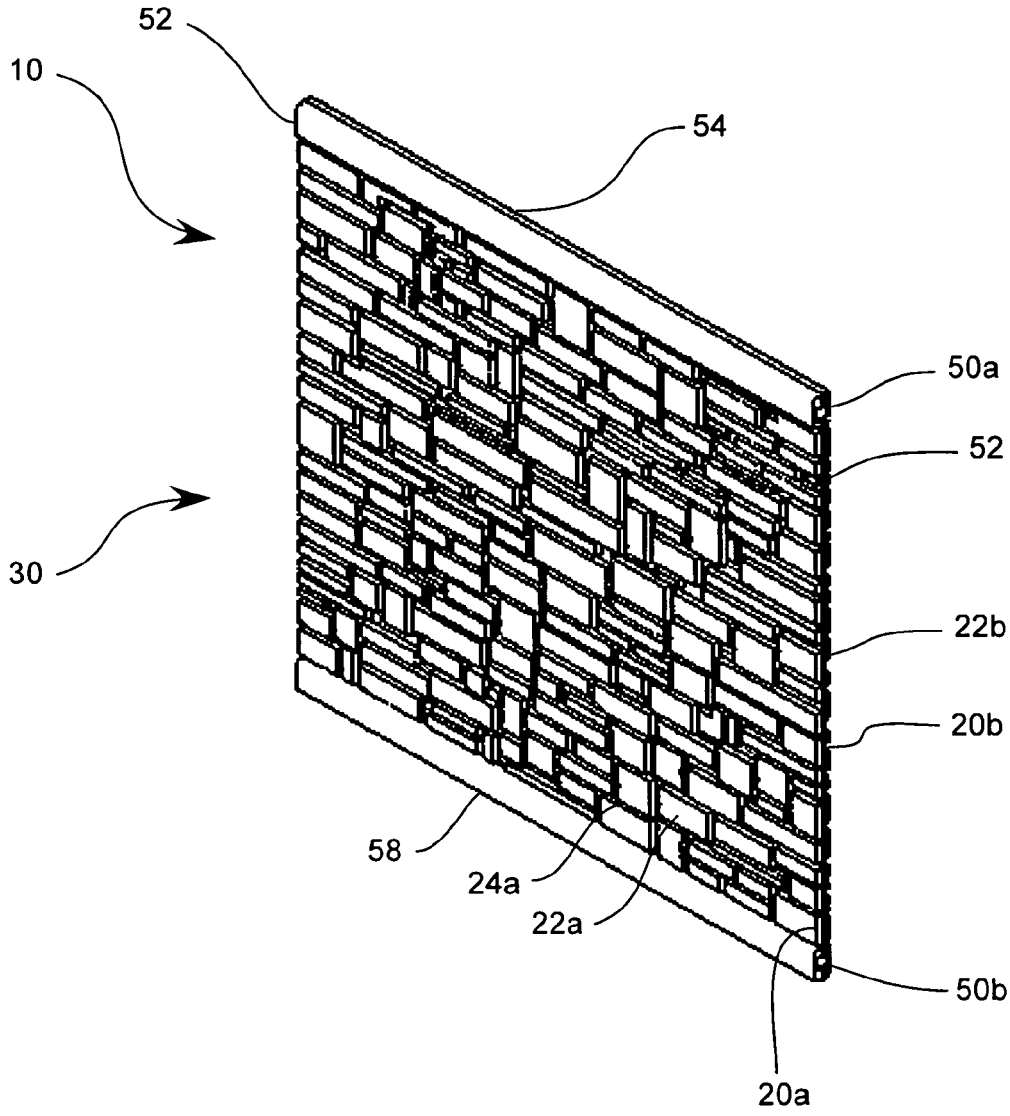
FIG. 1 is a perspective view of decorative fence panel in accordance with an embodiment of the present invention.
Figure 2:
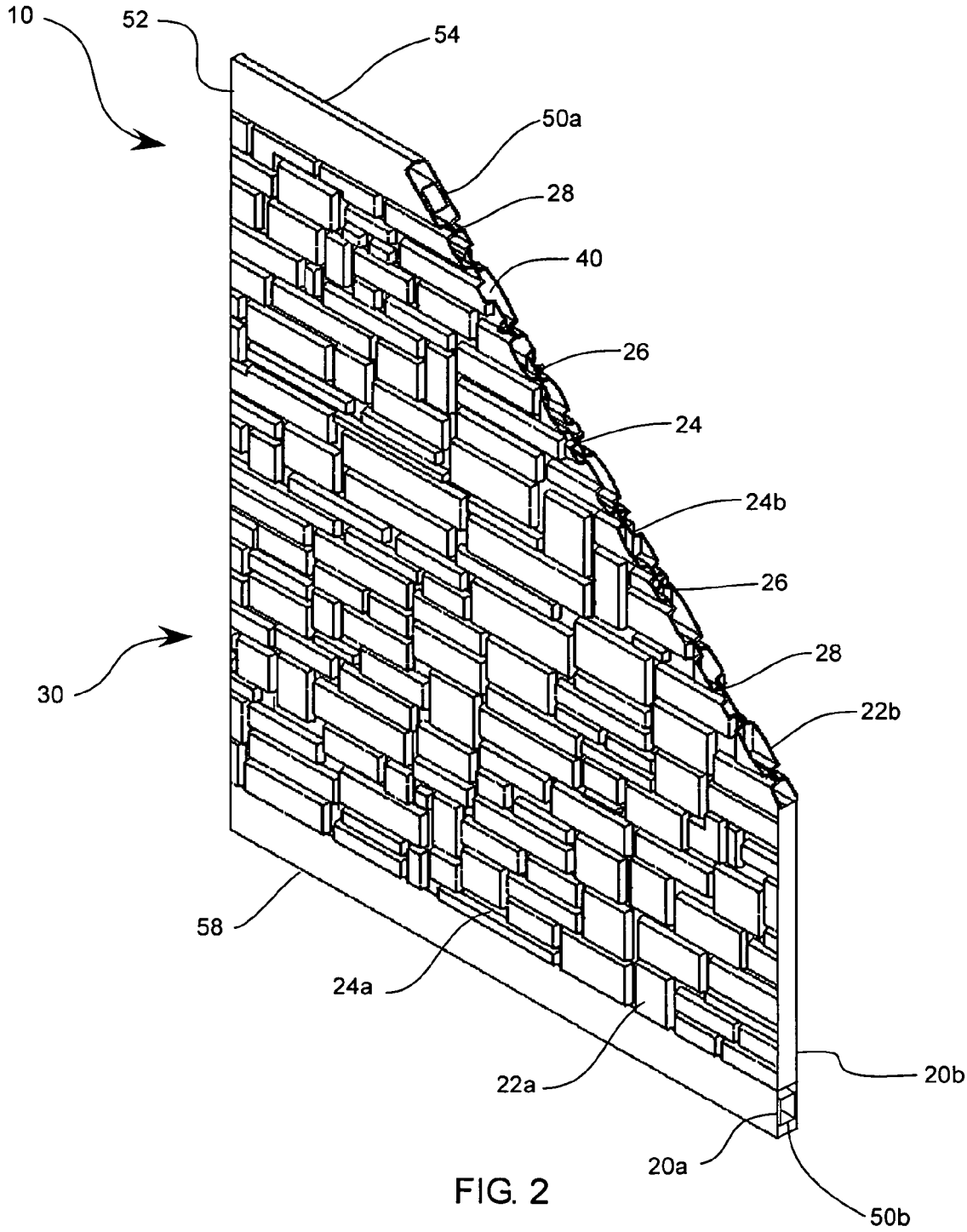
FIG. 2 is a perspective cut-away view of the decorative fence panel of FIG. 1.
Figure 3:
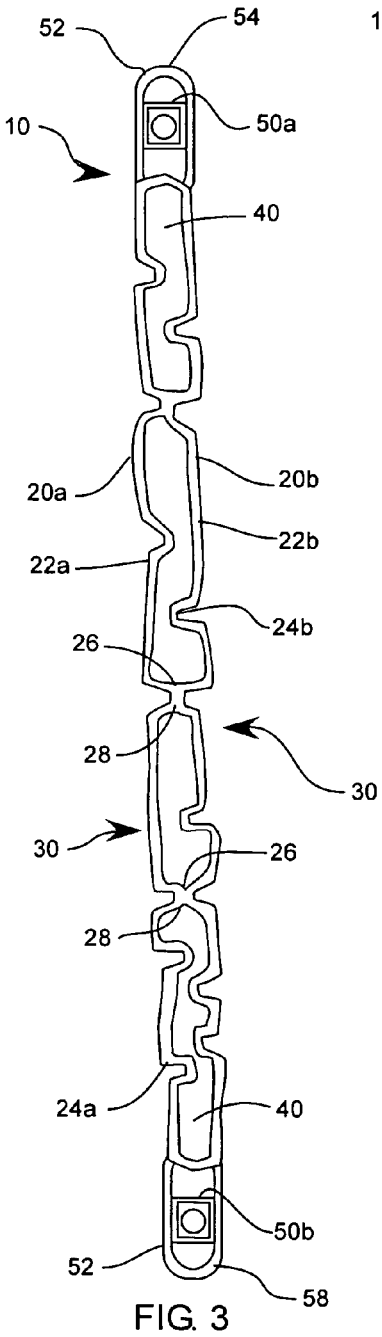
FIG. 3 is cross sectional view of the decorative fence panel of FIG. 1.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As described in Applicants' other application (Ser. No. 11/256,216) molded fences can include a reinforcing member, particularly with respect to fence posts that are securable to a support surface. Such fence posts may be fabricated by forming a skin, such as by blow molding, rotational molding, injection molding, or vacuum forming to produce a plastic shell, with a metal frame disposed in the shell or connected to the exterior of the shell to add structural rigidity. In some cases, an expansive foam material, such as polyurethane foam, may be injected into the shell after curing of the shell to fill the interior and increase the stiffness of the fence post.

Unfortunately, an integrated structural frame or reinforcing member can be problematic in a molded fence post because the frame generally has different thermal expansion characteristics than the polymer material fence post. Thus, the polymer shell and foam core can shrink significantly during post mold cooling, whereas an integrated metal frame will shrink much less because the frame's coefficient of thermal expansion is usually much smaller than that of the polymer material. This difference in post mold cooling shrinkage can produce significant internal stress inside the molded fence post especially when the polymer material of the shell and foam core bonds or adheres to the frame. This internal stress can cause undesirable deformation resulting in warping of the fence post, localized deformities, local cracking of polymer material, and crushing of the form core material against the ends of the frame members.

The present invention provides for a decorative fence post for use with a decorative fence panel as described in U.S. patent application Ser. No. 11/256,216, filed Oct. 21, 2005, which is herein incorporated by reference in its entirety for all purposes. The decorative fence post can have at least one vertical groove extending substantially the length of the post. The decorative panel can be slid into the groove on the post after the post is secured to a surface. The decorative panel can be retained in the groove by gravity alone, and substantially no mechanical fasteners are needed to secure the panel. The groove can be sized to accommodate thermal expansion of the panel. A reinforcing member can be disposed inside an outer shell of the fence post to strengthen and reinforce the post. A filler material, such as foam, can fill the outer shell and hold the reinforcing member in place without bonding to the reinforcing member. The filler material can be the same material as the outer shell and can have a different density than the material of the outer shell. In this way, the outer shell and filler material can be molded around the reinforcing member in a single pass molding operation and the filler material can be integral with outer shell. The reinforcing member can have a non-stick surface to reduce chemical or mechanical bonding between the filler material and the reinforcing member. Additionally, a void can be formed in the filler material around at least one end of the reinforcing member. Together the non-stick coating and the void can allow the outer shell and the filler material to shrink during post mold curing without interference from the reinforcing material, and thus reduces warping or deformation of the decorative fence post that may be caused by bonding of the filler material or outer shell to the reinforcing member.

The decorative fence panel can be molded from a polymeric resin to simulate another fencing material such as rock, stone, or wood or the like. The panel can be configured to fit between two decorative fence posts. The decorative fence posts can have the same pattern or a complementary pattern to the panel. The panel can be substantially hollow between two opposite plastic walls, but the walls can indent into the hollow space toward the opposite wall to form a grid of traversing channels simulating grout lines, slat lines, or the like, on each wall. These channels can intersect inside the hollow space at select locations to form a grid of nodes of continuous polymeric resin material that criss-cross throughout the hollow space and across the panel. The nodes form thermal pathways and facilitate thermal conduction between the two walls to resist differential thermal loads, and thus warping of the panels. The nodes also form structural connections between the opposite walls. The grids of traversing channels also break-up the broad surface of the walls to allow discrete and/or isolated thermal expansion between the channels to further resist warping (like an "accordion effect").

As illustrated in FIGS. 1-4, the decorative fence panel, indicated generally at 10, in accordance with the present invention is shown. The decorative fence panel 10 has two opposite plastic walls 20*a* and 20*b* (perhaps best seen in FIGS. 3 and 4). The opposite walls 20*a* and 20*b* have opposite facing exterior surfaces 22*a* and 22*b* that can be substantially spaced apart from one another. In one aspect, the opposite surfaces 22*a* and 22*b* can be spaced apart less than approximately two to three inches, such that the panel 10 has a thickness less than approximately two to three inches.

The decorative fence panel 10 can be sized to accommodate standard sized fences. In one aspect the decorative fence panel 10 can be approximately 6 feet high by 6 feet wide, such that the panel can be used in a 6 foot high fence. In another aspect the panel can be approximately 3 feet high and 6 feet wide and can be used in a 3 foot high fence. Advantageously, because the decorative fence panel 10 is a polymeric resin or plastic, the panel can be cut to fit into fencing applications that are smaller than the size of the panel. Additionally, because the decorative fence panel 10 can be cut to a desired size or shape, the panel is particularly suited to fencing uneven terrain. In cases of uneven terrain, such as sloped elevations or unmovable obstacles, the bottom of the decorative fence panel 10 can be cut to accommodate the terrain and the top remains aesthetically pleasing and similar to adjacent fencing. The panels can be cut without substantially affecting any physical properties such as strength, stiffness, rigidity, or heat transfer properties, of the panel.

Each of the opposite walls 20*a* and 20*b* has a grid of traversing elongated channels 24*a* and 24*b* formed by inward deflections in the walls, or each wall 20*a* and 20*b* bending inward towards the opposite wall. The walls 20*a* and 20*b* can have a substantially constant thickness across the panel, and can bend or deflect inwardly to form the channels. Each grid has channels that traverse, intersect, and/or cross one another. The grids, or channels forming the grids, can be irregular to form protrusions therebetween that simulate other fencing materials, as discussed below. In addition, the channels can have different and/or irregular lengths to further form protrusions that simulate other fencing materials. The channels themselves can simulate grout or mortar lines. Furthermore, each individual channel can be discontinuous across the panel. Thus, the channels break-up the broad surface of the panel to isolate and mitigate thermal expansion, as discussed below.

The grids or traversing channels 24*a* and 24*b* define a decorative profile of a fence, indicated generally at 30. The decorative profile 30 and/or the grids of traversing channels can simulate a fencing material, such as stone (as shown), rock, brick or wood. The walls can have any decorative profile, or can simulate any fencing material. The decorative profile 30 can simulate a fence material such as brick, stone, rock, wood, vinyl, slats, log poles, herringbone, lapped wood, cedar slats, river rock, wrought iron, simulated wood, simulated rock, simulated stone, simulated brick, and lava rock. Additionally, the decorative profile 30 can simulate a combination of fence materials. For example, the bottom half of a panel may simulate rock while the top half may simulate wood slats extending upward from the rock. Protrusions can be defined between the channels that are larger than the channels, or that are wider and longer than the width of the channels. The protrusions can simulate a fencing material like bricks, stone or rock, while the channels can simulate grout or mortar between the bricks, stones or rocks, as shown. Alternatively, the protrusions can simulate wood slats, while the channels can simulate gaps or slat lines between the wood slats. It will be appreciated that the protrusions can have an exterior surface that is textured, or that itself contains indentations and protrusions to simulate a fence material.

The grid of traversing channels 24 can be shaped and sized to simulate grout lines, mortar lines, or slat lines between protrusions on the decorative fence panel that simulate rock, stone, brick, wood, vinyl, or the like. In one aspect, the elongated channels 20 can be substantially linear, can be oriented substantially horizontally and vertically, and can intersect one another at substantially right angles to simulate grout lines between slate stone or quadrangular shaped rock. In another aspect, the elongated channels 20 can be curvilinear and can intersect one another at oblique angles to simulate grout lines between semi-spheroidally shaped rocks, such as river rock. The channels can be elongated and straight, and can be oriented horizontally and vertically, as shown, to simulate grout lines between protruding quadrangular stone. In addition, the channels are discontinuous across the panel, and have different lengths to define protrusions between the channels that simulate a fencing material such as stone, brick, wood or the like. Alternatively, the channels can be arcuate, and can define rounded protrusions, to simulate rock. It will be appreciated that numerous configurations are possible to simulate numerous fencing materials.

The opposite facing exterior surfaces 22*a* and 22*b* of the opposite walls 20*a* and 20*b* can also have different decorative profiles 30 with respect to one another so that each side of the decorative fence panel 10 can simulate a different fence material. For example, the exterior surface 22*a* of one wall 20*a* could simulate rock, while the exterior surface 22*b* of the opposite wall 20*b* could simulate vinyl fencing. In this way, the decorative fence panel can be used to augment an existing fence on one side of a fence line and a different fence on the other side of the fence line. Advantageously, this allows owners of adjacent property to share a common fence line, but each have a distinctive appearance on the fence facing their property.

The grid of traversing channels 24*a* and 24*b* can also form a plurality of separate and discrete physical connections 26 between the opposite walls 20, or inside the panels. The connections 26 can be spread across, or be disposed across, the decorative panel 10. The connections 26 can be formed by select intersections of the inward deflections that form the grids of traversing channels 24*a* and 24*b* in the opposite walls 20*a* and 20*b*. Specifically, a wall 20*a* bending in towards the opposite wall 20*b* and forming a channel 24*a* can intersect another channel 24*b* bending in from the opposite wall 20*b*. This intersection forms a continuous material node 28 that can have the same material composition as the opposite plastic wall, and is continuous throughout the node 28. A plurality of these intersections can form a plurality of continuous material nodes 28 that are spread across, or are disposed across, the decorative panel 10 between the opposite walls 20*a* and 20*b*. These continuous material nodes 28 can have a thickness between opposite facing exterior surfaces 22 of approximately one to two times the thickness of the opposite plastic walls 20. It has been found that such a thickness facilitates manufacturing of the nodes and the panels, while maintaining a sufficient thickness of the material to avoid thin or translucent spots in the panel.

Advantageously, the continuous material nodes 28 can help in controlling internal forces on the panel 10. In particular, the nodes 28 can form thermal energy transfer paths between the opposite walls 20*a* and 20*b* to transfer thermal energy between the opposite walls. Thus, as one wall is heated or cooled, such as by direct sunlight, the thermal energy is transferred through the thermal energy pathway to the opposite wall. In this way, the continuous material nodes 28 can transfer heat from one wall 20*a* to the other wall 20*b* to resist differential thermal expansion between the opposite walls, and thus reduce or resist warping of the decorative fence panel 10.

The grid of traversing channels 24*a* and 24*b* and the continuous material nodes 28 also provide an "accordion" like structure that attenuates the effects of thermal expansion within a wall 20*a* or 20*b*. In particular, the grid of traversing channels disrupts the plane of each of the walls so that thermal expansion in the planar direction of the wall is disrupted and localized, as opposed to extending over an entire length or width of the wall. Furthermore, the expansion that does occur over each individual portion of the wall is deflected, or absorbed, by the adjacent grid of traversing channels, and thus overall expansion across the entire wall is much less than if the wall was a single planar sheet, or extended continuously from one side to the other. Advantageously, this deflection effect minimizes warping of the wall, and also the panel 10, during the high heat conditions of the panel forming process. Additionally, the deflection effect minimizes warping or deformation from smaller thermal changes caused by changes in ambient temperatures, as well as thermal differentials across the panel 10 caused by direct sunlight on one portion, or side, of the panel 10 and shadows on another portion.

The grid of traversing channels 24*a* and 24*b* and the continuous material nodes 28 also stiffen and strengthen the opposite walls 20*a* and 20*b* by introducing orthogonal prestressed planar deflections and mechanical connections between the walls. These deflections and mechanical connections enhance the rigidity and strength of the panel 10 resulting in a two wall panel that is less susceptible to a vibrational "drum" effect between the walls. Advantageously, the increased strength and rigidity of the panels 10 that is created by the grids of traversing channels 24*a* and 24*b* and the continuous material nodes 28 make the panel 10 highly resistant to normal, perpendicular, or transverse loads caused by wind or physical collision or impact with the walls 20*a* and 20*b*.

The connections between the opposite walls 20*a* and 20*b* are discontinuous across the walls, or the panel. Thus, at least one continuous, non-linear space 40 can be formed between the opposite walls 20*a* and 20*b* by the continuous material nodes 28. Thus, the continuous material nodes 28 can close off select portions between the two walls, but leave a continuous, non-linear, or labyrinth-like space between the opposite walls 20 that is open across the entire panel 10. The continuous space can facilitate manufacture, such as by rotational molding. The continuous, non-linear space 40 between the opposite walls 20*a* and 20*b* can be hollow, or the space 40 between the opposite walls 20*a* and 20*b* can be empty. It has been found that a hollow panel is sufficiently strong, and is believed to reduce manufacturing costs. In another aspect, the space 40 between the opposite walls 20*a* and 20*b* can contain a filler material. The filler material can be an insulating material such as glass, foam, spun fiber, or mixtures of these materials. The filler material can also be a structural material such as grout, aggregate, sand, concrete, and mixtures of these materials. Other materials such as liquids can also fill the space between the opposite walls. Such fillers can dampen sound, provide structural rigidity or stiffness, etc.

Figure 4:
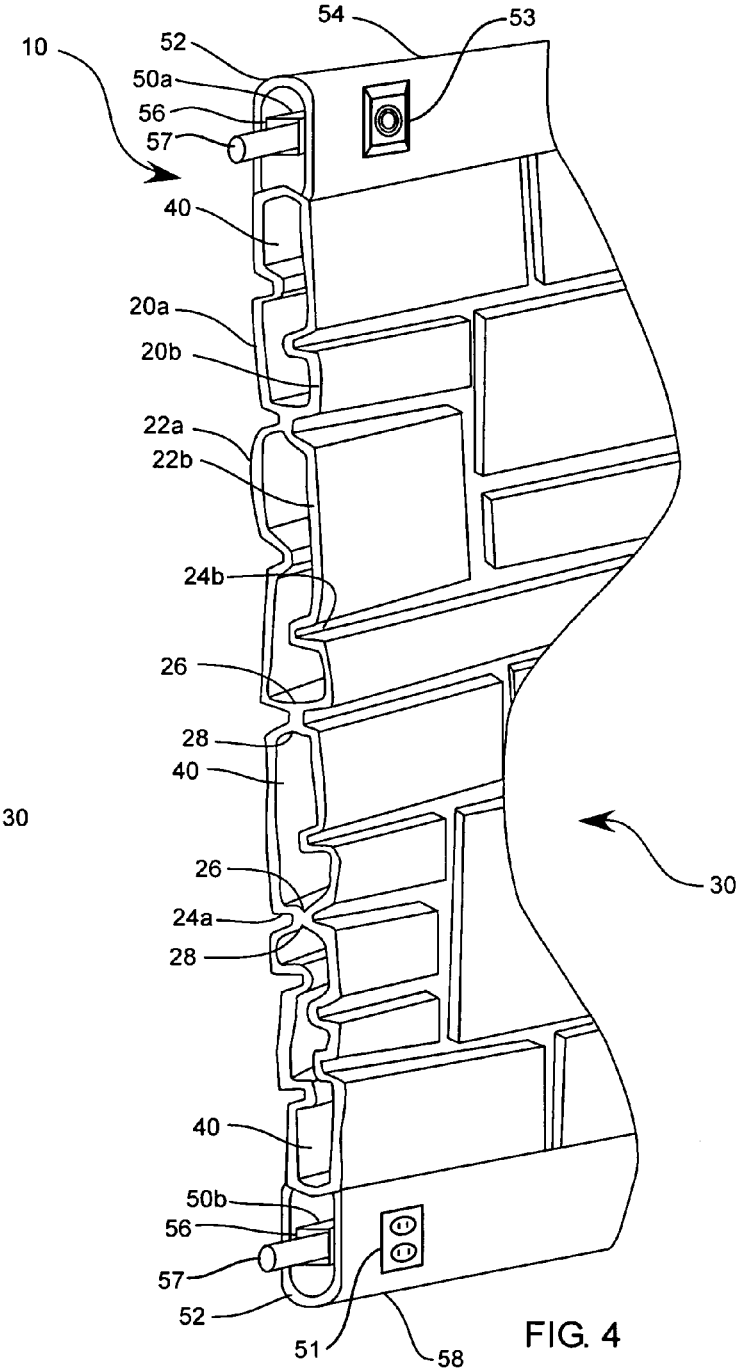
FIG. 4 is a partial perspective view of the decorative fence panel of FIG. 1.

An elongated insert 50*a* can extend longitudinally along a top 54 of the decorative fence panel 10 between the opposite walls 20*a* and 20*b*. Another elongated insert 50*b* can extend longitudinally along a bottom 58 of the decorative fence panel 10 between the opposite walls 20. The elongated inserts 50 can have opposite ends 56 that extend beyond the perimeter 52 or lateral edges of the decorative panel 10, or the walls 20*a* and 20*b*, as shown in FIG. 4. These elongated inserts 50 can reinforce the decorative panel 10 and strengthen the panel against normal or perpendicular forces, such as wind.

The inserts 50*a* and 50*b* can be disposed in elongated hollows in the panel, and can be maintained therein without any fasteners or adhesive so that the panel or walls can expand and move along the inserts during thermal expansion. The inserts 50*a* and 50*b* can be single, continuous members. In one aspect, the inserts can be formed of metal, such as galvanized steel or aluminum. In another aspect the inserts can be made of composite, wood, or plastic materials. The panel can have elongated protrusions along the top and bottom to accommodate the inserts therein.

Advantageously, the elongated inserts 50*a* and 50*b* can provide a continuous tube through out the length of the panel 10 and adjoining panels. Thus, the elongated inserts 50*a* and 50*b* can form conduits throughout a fence that can facilitate various utility lines 57, such as electrical power wires, phone wires, data communication wires, gas piping, water piping, or other similar utility lines. In this way, the decorative fence panel 10 of the present invention can provide access to various utilities throughout the fenced area. The decorative fence panels 10 can have suitable warning labels molded or affixed thereto, in order to warn of the presence of utility lines within the fence.

In the case where the elongated inserts 50*a* and 50*b* house electrical line, the elongated inserts can be electrical conduit that is fully compliant with existing building codes, as known in the art. The elongated inserts 50 and 50*b* can house high voltage or low voltage electrical lines. Additionally, electrical receptacles can be formed in the decorative fence panel adjacent the elongated inserts 50*a* and 50*b* and can hold electrical sockets, plugs 51, or decorative lighting fixtures 53. In one aspect the decorative fence panels 10 can be pre-wired at the time of manufacture and shipped in a ready-to-install configuration. In another aspect the electrical lines and fixtures can be wired into the decorative fence panel at the time of installation by a qualified electrician.

The decorative fence panel 10 or walls 20*a* and 20*b* can be formed by a molding process, such as rotational molding, or rotational molding. Additionally, the opposite walls 20*a* and 20*b* with the grids of traversing channels 24*a* and 24*b* and the continuous material nodes 28 can be formed by blow molding, injection molding, gas assist injection molding, water assisted injection molding, vacuum molding, compression molding, pultrusion or combinations of these processes, as known in the art. The decorative fence panel 10 can also be formed by a plastic forming process such as thermoforming, twin sheet thermoforming, extrusion forming, and combinations thereof. Other composite processes might be utilized, such as VARTM, RTM, hand layups, bulk molding compound, sheet molding compound, etc.

The opposite plastic walls 20*a* and 20*b* can be made from a polymeric resin material such as thermoplastic or thermoset resin, and/or can be made from olefins, styrenes, nylons, or mixtures of these polymeric families. In one aspect, the opposite plastic walls can be formed from an olefin, such as polyethylene or polypropylene, or the like. In another aspect, the opposite plastic walls can be formed from a styrene, such as acrylonitrile butadiene styrene (ABS), or the like. In still another aspect, the opposite plastic walls can be formed from a mixture of olefins and styrenes. The polymeric resin material can also be made from recycled olefin, styrene, or nylon products. It will also be appreciated that the material of the walls can include additives, such as glass, fiber, talc, UV resistive or protective materials, etc. In one aspect, plastic granules of different colors can be combined to obtain a wall color that is a composite color to more readily simulate another material.

The opposite walls 20*a* and 20*b* can have a constant material composition from one exterior surface 22*a* to an interior surface. Advantageously, a constant material composition throughout the wall 20 maintains the pleasing aesthetic appearance of the wall 20*a* and 20*b* in the case where the wall is dented, nicked, scratched, cracked, or otherwise damaged. In such instances, the color of the wall underneath the exterior surface is the same as the color and composition of the wall on the exterior surface. Consequently, damage to the exterior surface is less noticeable than the case where the wall is superficially coated on its surface with a texturizing material or colorant.

Colorants may be added into the molding or forming process to color the wall to any desired color. In this way, the simulation of rock, brick, wood or other fence material can be made to appear more realistic.

Additionally, the channels 22*a* and 22*b* can be colored a different color than the protrusions between the channels that simulate the fencing material. For example, the channels can be colored in a post molding operation. Thus, the channels can be made to appear as more realistic grout, mortar, or slat lines in a fence.

The channels and protrusions can also be the same material and color. It has been found that the shadow created in the channels provides a sufficient contrast to the protrusions to create a grout looking appearance sufficient to meet many cosmetic purposes.

There are several additional advantages to using a molded polymeric resin to form the decorative fence panel 10 of the present invention. For example, polymeric resin fence panels have a high strength to weight ratio, so that they are light in weight but very strong. Moreover, additional additives can be added to the polymeric resin during the forming process of the fence panel to improve the properties of the fence. For example, impact modifiers such as chopped fibers, glass microspheres, talc, woodflour, crushed walnuts, or the like, can be added to improve the physical properties of the fence, such as the impact resistance of the panels. Additionally, anti-microbial chemicals can be added to resist the growth of mold or other microbial contaminants on the fence panel during use. Furthermore, ultra-violet inhibitors can be added to protect the polymeric resin from damage due to ultra-violet sun rays. Other additives can be added to achieve desired properties of a fencing system, as known in the art.

Figure 5:
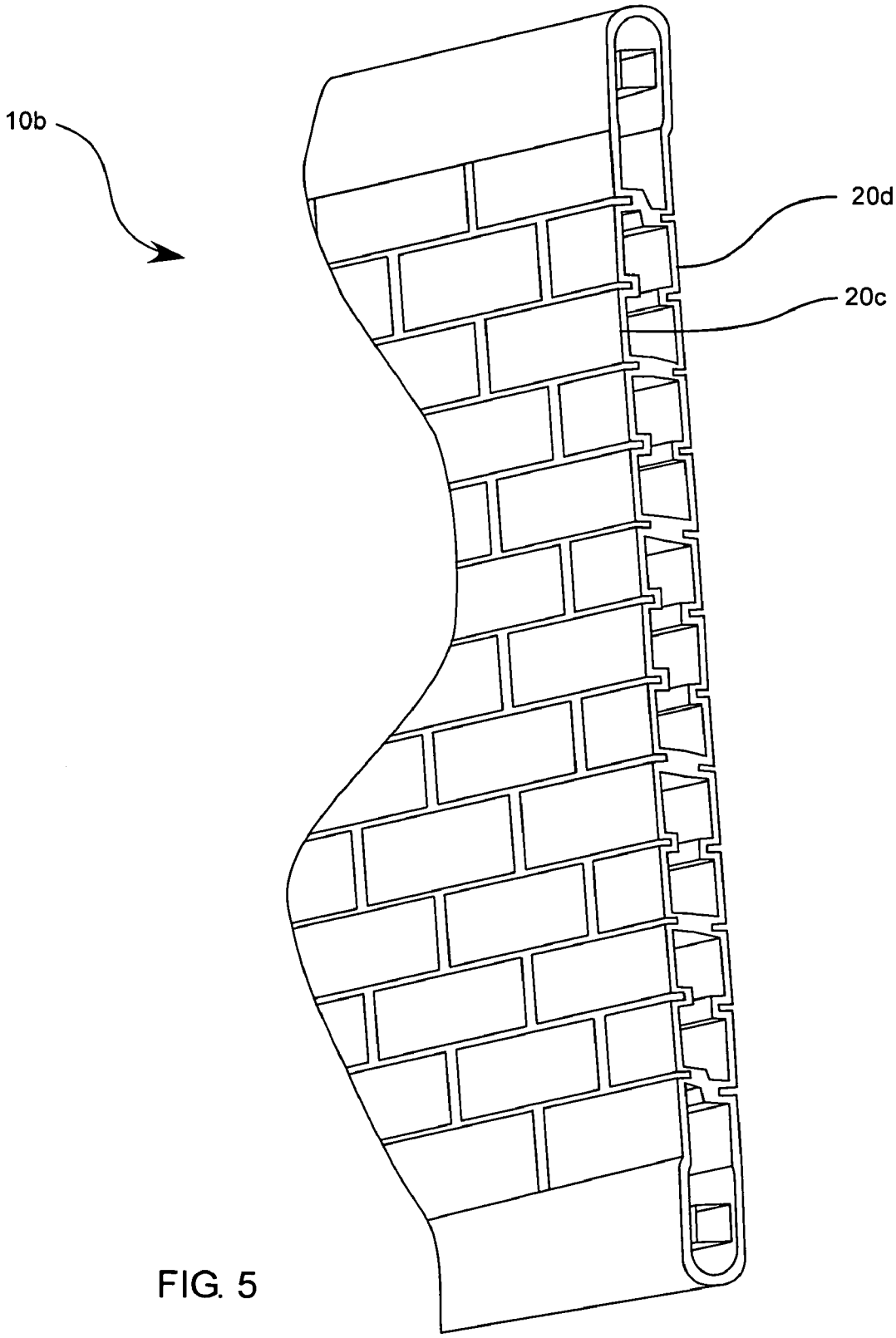
FIG. 5 is a partial perspective view of the decorative fence panel of FIG. 1 with a different decorative profile.
Figure 6:
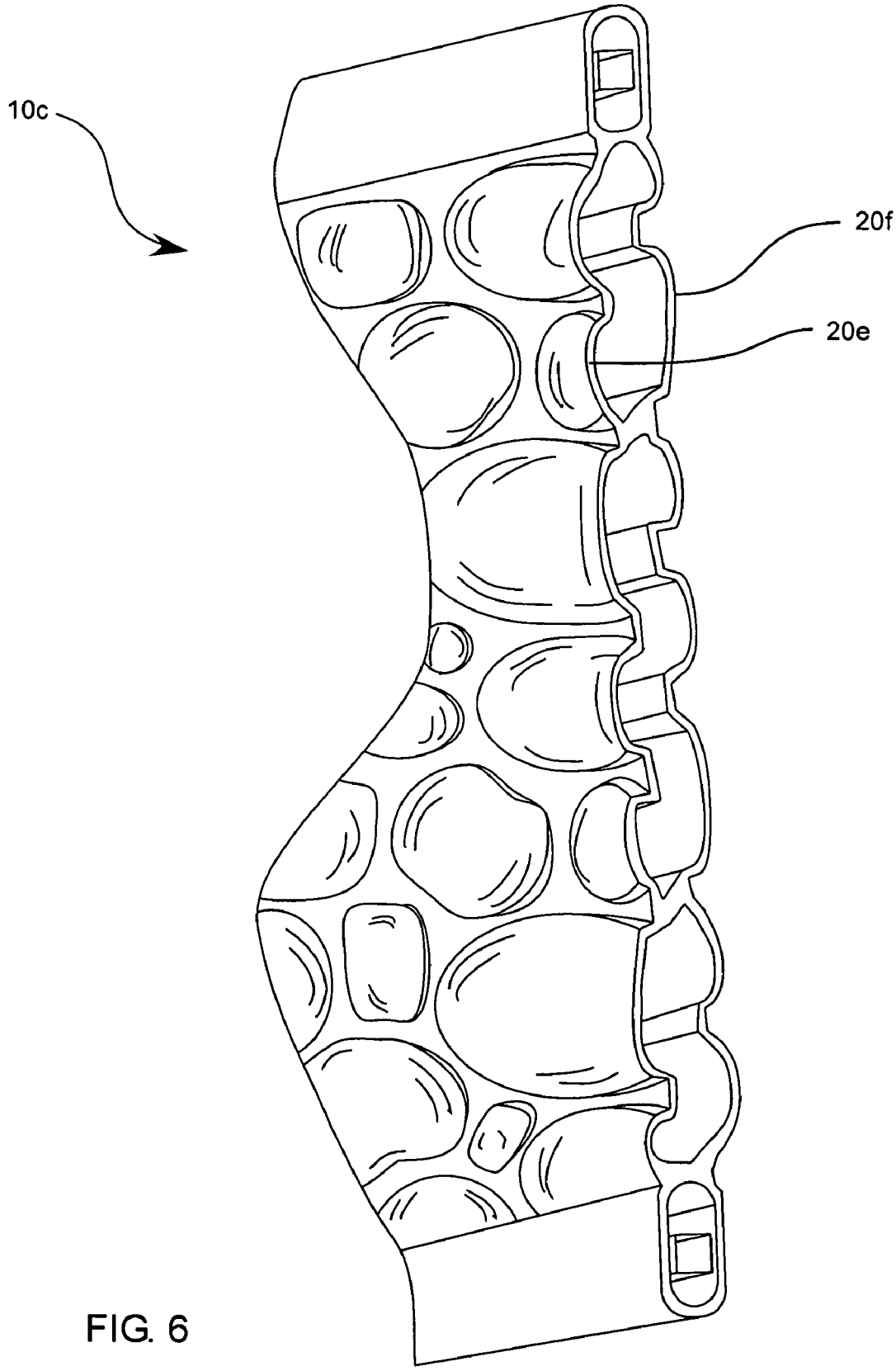
FIG. 6 is a partial perspective view of the decorative fence panel of FIG. 1 with a different decorative profile.
Figure 7:
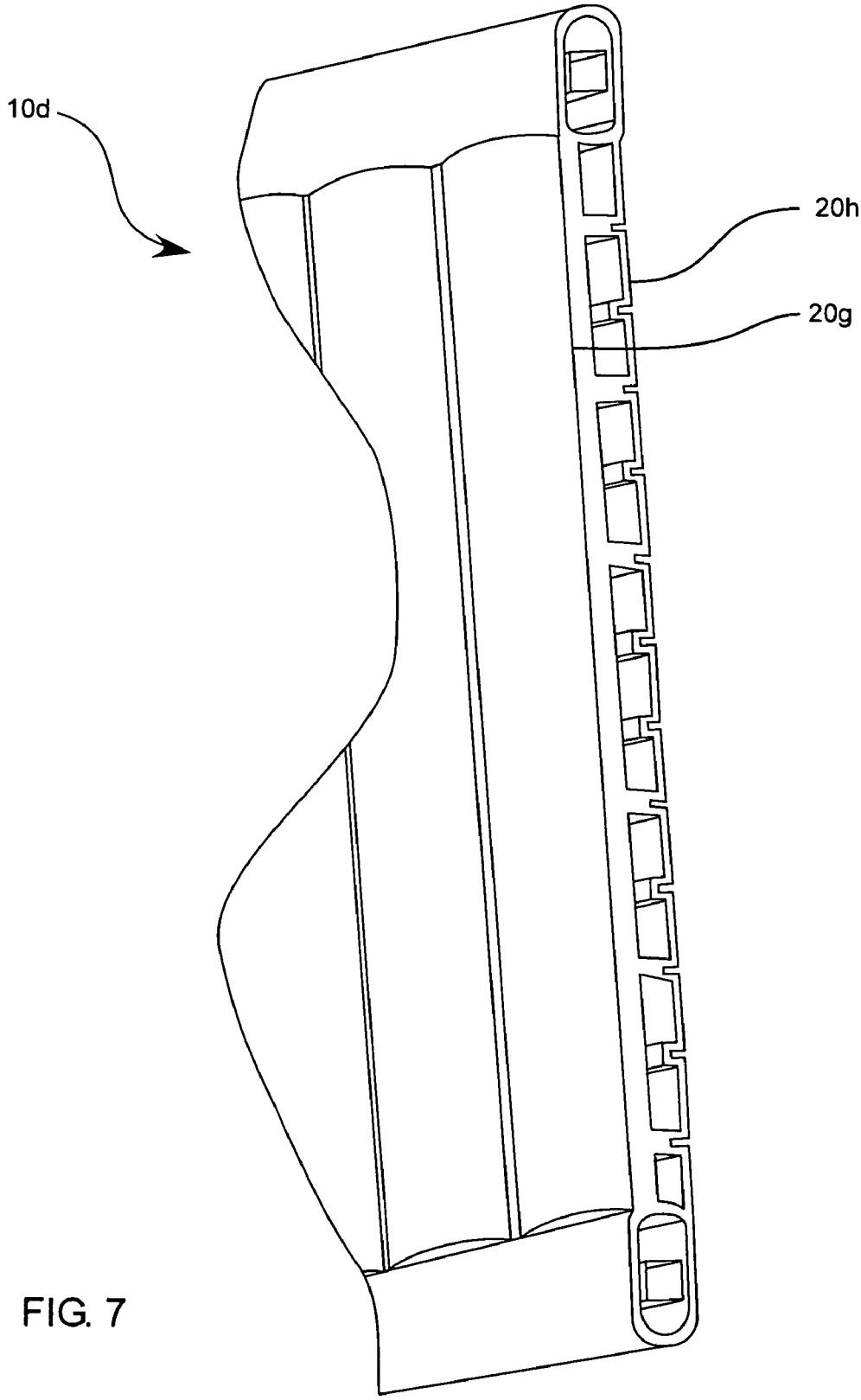
FIG. 7 is a partial perspective view of the decorative fence panel of FIG. 1 with a different decorative profile.

As illustrated in FIGS. 5-7, the decorative fence panels 10 can simulate a variety of common fencing materials, as described above. FIG. 5 shows the decorative fence panel 10*b* with opposite walls 20*c* and 20*d* simulating brick. FIG. 6 illustrates a decorative fence panel 10*c* with opposite walls 20*e* and 20*f* simulating semi-spheroidal stones, such as river rock. FIG. 7 illustrates a decorative fence panel 10*d* with one wall 20*g* simulating vertical slats, such as cedar slats, and the opposite wall 20*h* simulating brick.

Figure 8:
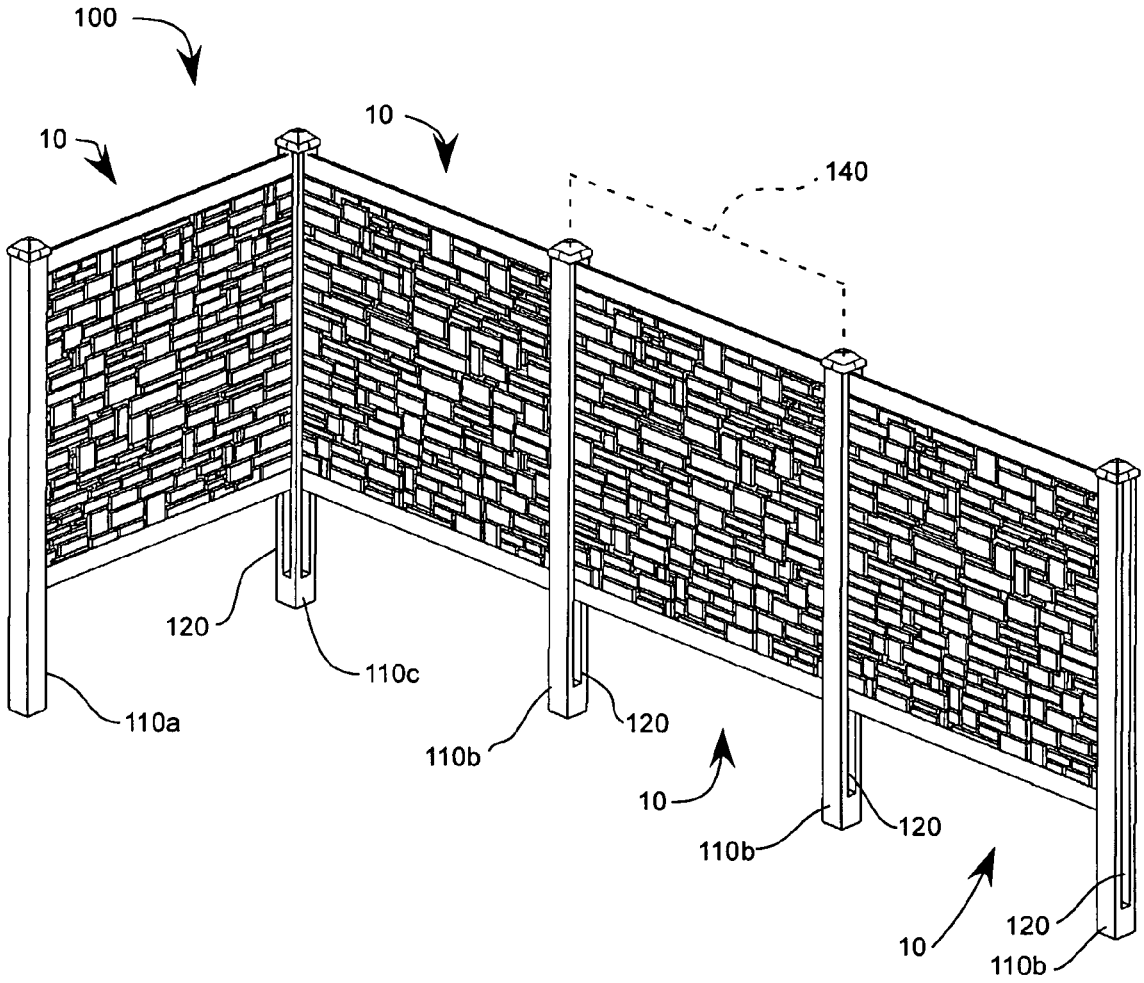
FIG. 8 is a perspective view of a fence system using the decorative fence panel of FIG. 1.
Figure 9:
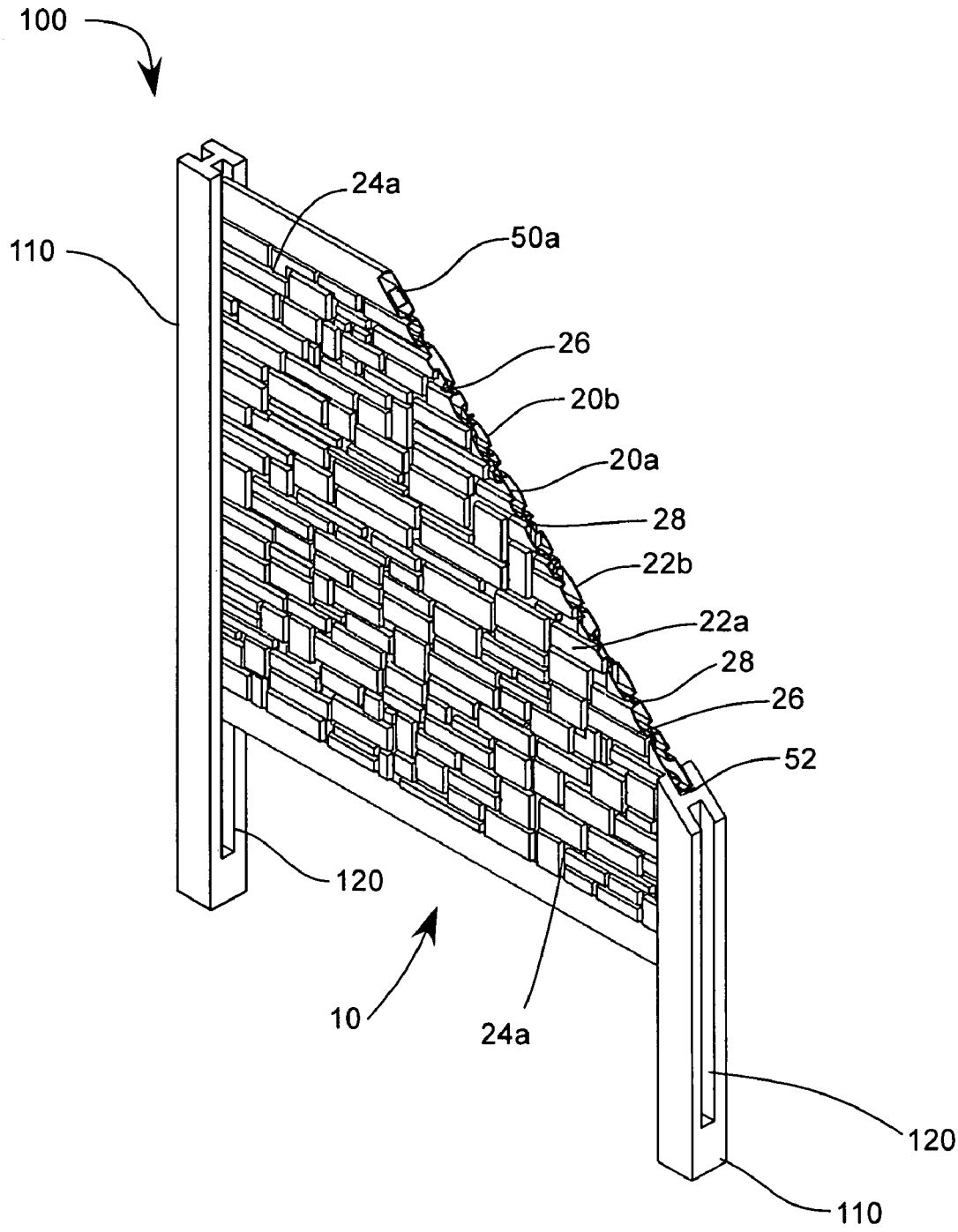
FIG. 9 is a partial perspective view of the fence system of FIG. 8.
Figure 10:
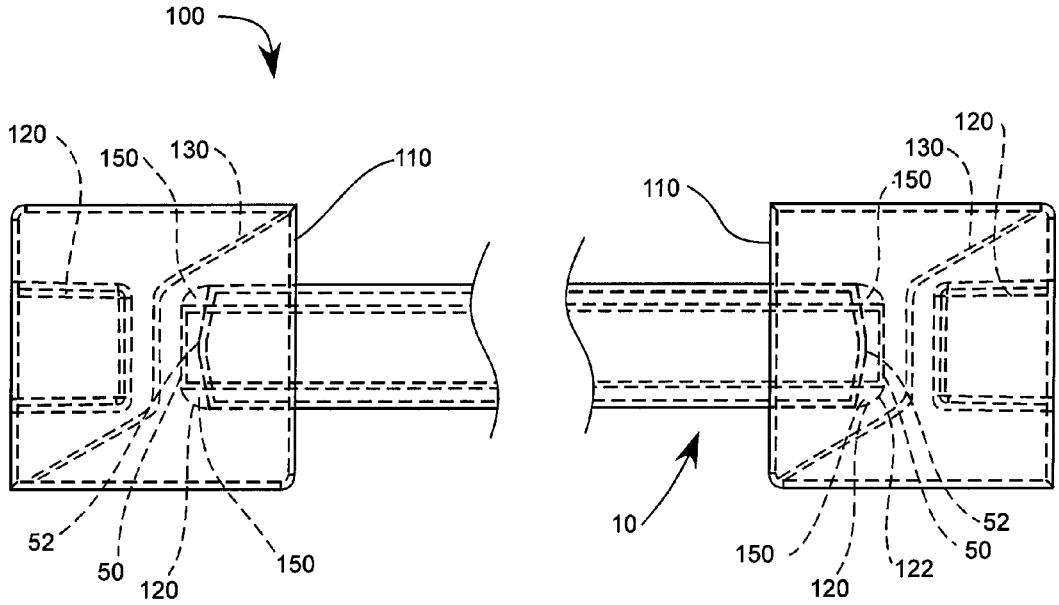
FIG. 10 is partial top view of the fence system of FIG. 8.
Figure 11:
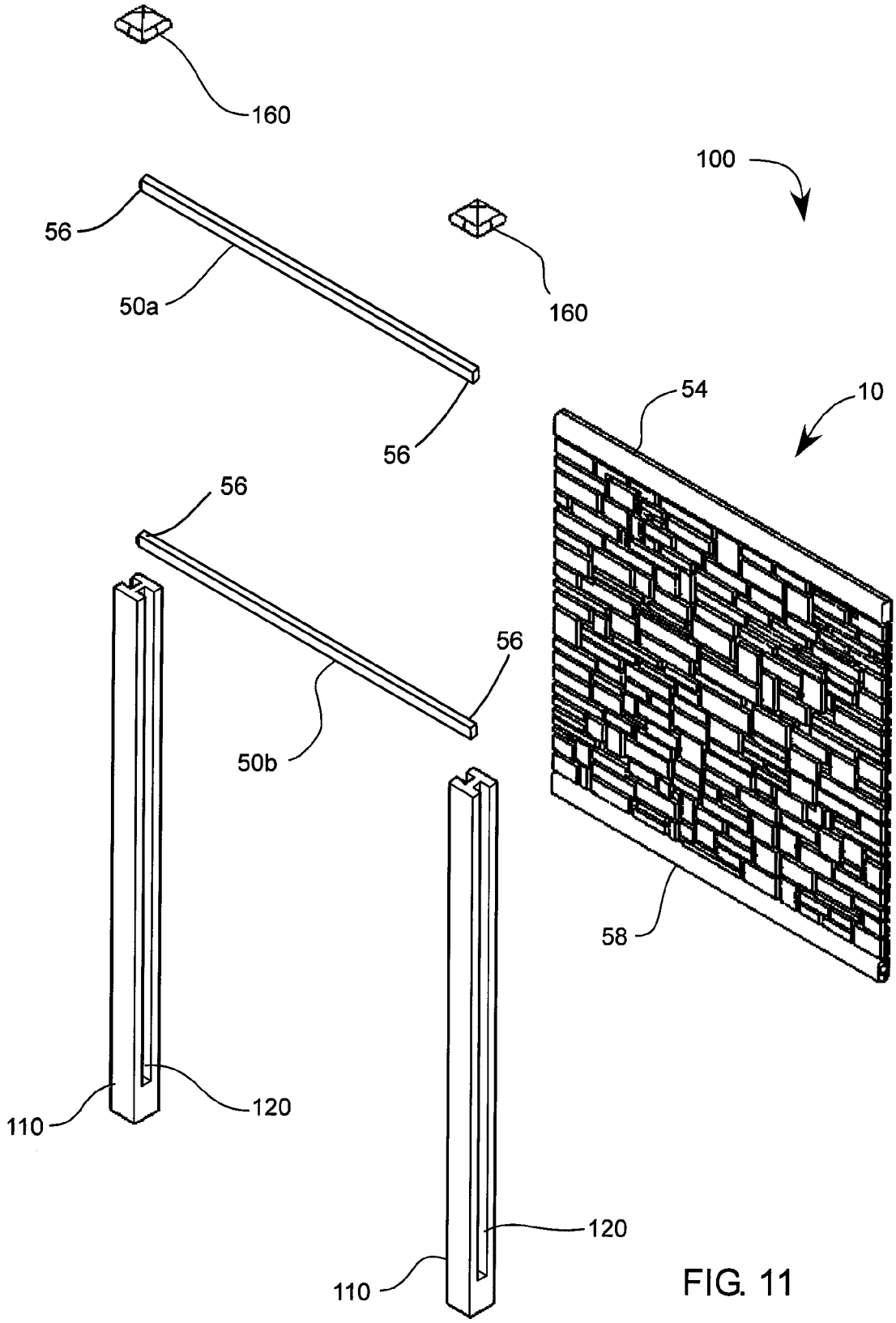
FIG. 11 is a perspective exploded view of the fence system of FIG. 8 and shows the method of installing the fence system.
Figure 12:
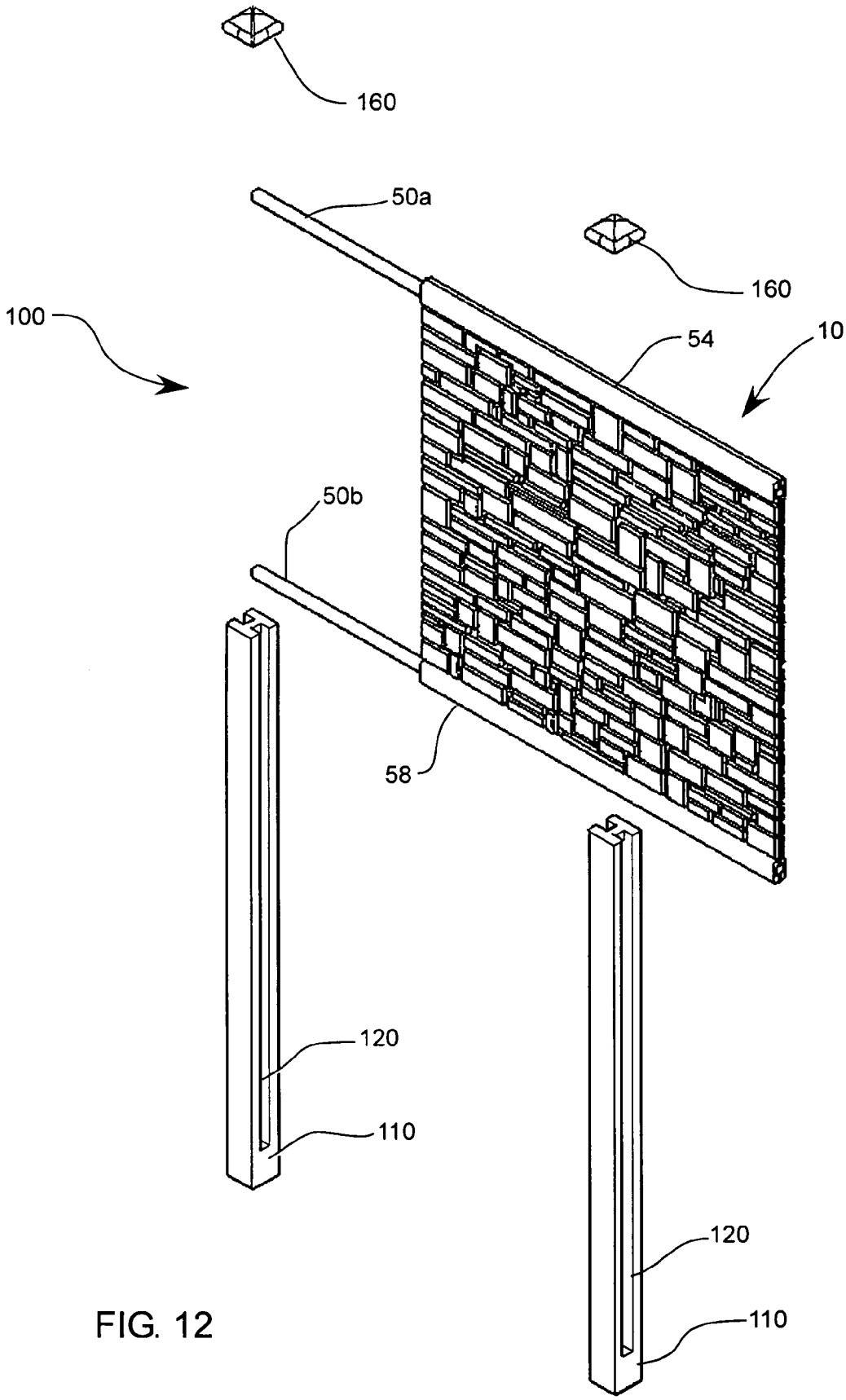
FIG. 12 is a perspective view of the fence system of FIG. 8 in a partially installed configuration.
Figure 13:
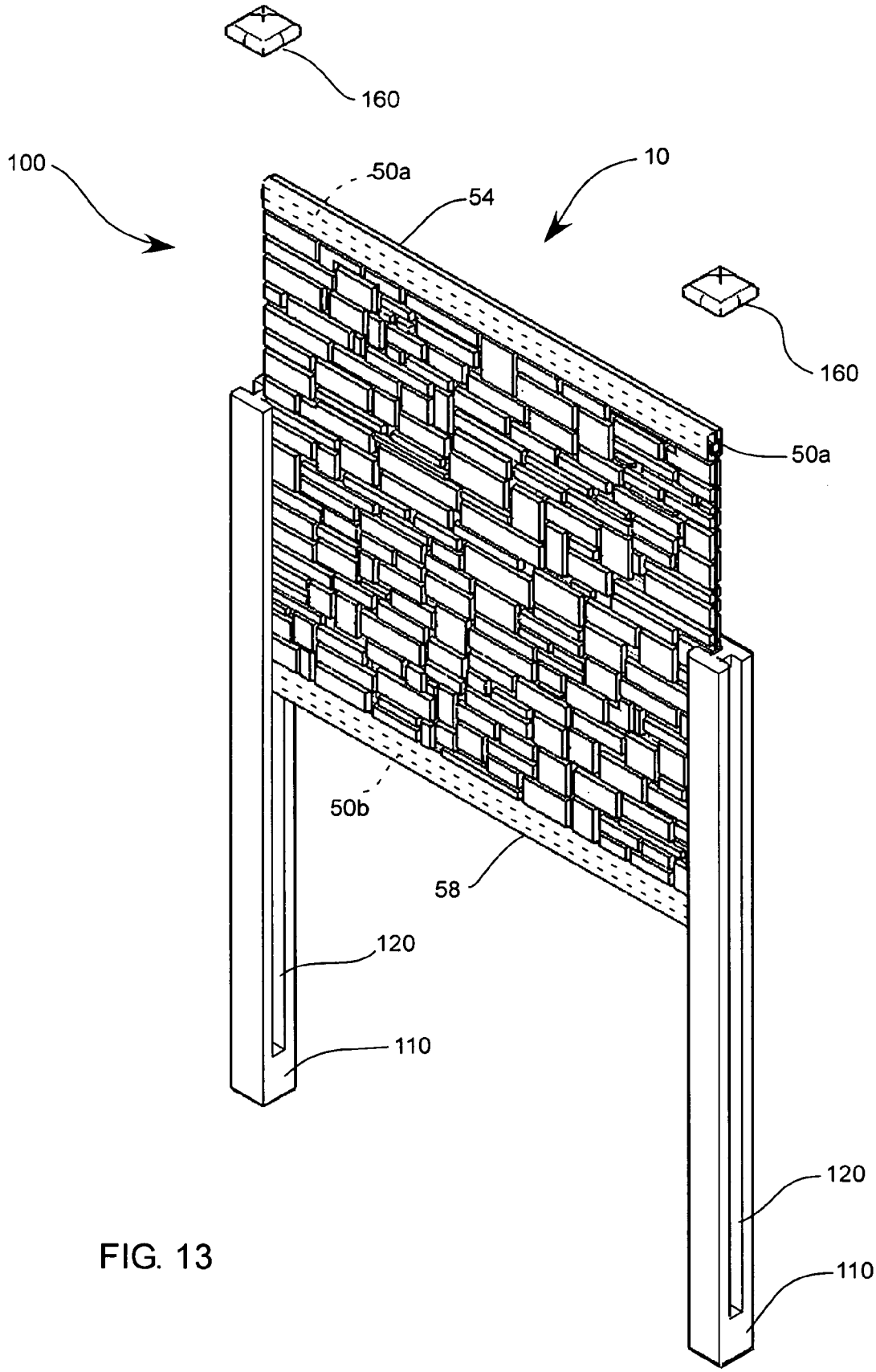
FIG. 13 is a perspective view of the fence system of FIG. 8 in a partially installed configuration.
Figure 14:
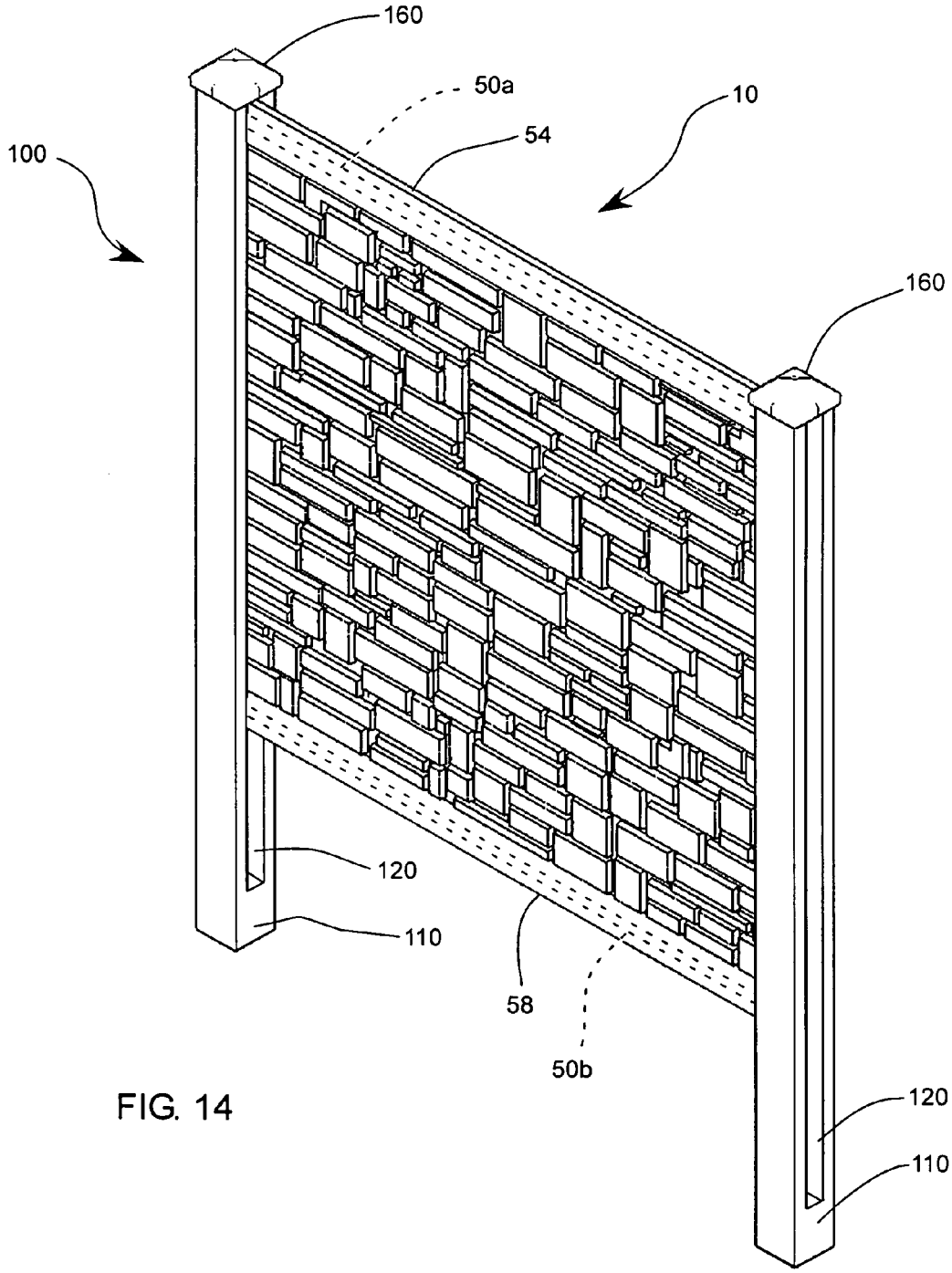
FIG. 14 is a perspective view of the fence system of FIG. 8 in an installed configuration.

Turning now to FIGS. 8-10, a plurality of decorative fence panels 10 in accordance with an embodiment of the present invention used in a fencing system, indicated generally as 100, is shown. The fencing system 100 has a plurality of decorative posts 110 that can be secured to a support surface, such as being buried in the ground, or attached to a concrete slab. The decorative posts 110 can have plastic walls made from a polymeric resin similar to the decorative fence panels 10. The plastic walls can be continuous around a perimeter of the post 110 and the post can be substantially hollow within the plastic walls, or can include inserts and/or foam. The plastic walls can simulate a similar fencing material to the decorative fence panels, or a complementary fencing material.

A foam material or other filler material, as known in the art, can be disposed within the hollow space to stiffen and strengthen the posts. Additionally, the posts can be formed to slip over the top of existing fence posts such as metal chain link poles, four inch by four inch wood or vinyl poles, metal stake poles, or the like. In the case where the post is used to cover an existing fence post, such as a metal chain link pole, sufficient support structure can be disposed inside the plastic walls to secure the plastic walls to the existing post. For example, the posts can have an elongated vertical cavity extending from the bottom so that the posts can slip over an existing post. The posts 110 can have sufficient length to support a 3 or 6 foot high fence, or other sized fences, as known in the art.

The decorative posts 110 can be formed by a molding process, such as rotational molding, or rotational molding, similar to the decorative fence panels 10 described above. Additionally, the posts 110 can be formed by blow molding, injection molding, gas assist injection molding, water assisted injection molding, vacuum molding, compression molding, pultrusion or combinations of these processes, as known in the art. The decorative posts 110 can also be formed by a plastic forming process such as thermoforming, twin sheet thermoforming, extrusion forming, and combinations thereof.

Each post 110 can have at least one longitudinal vertical groove 120 formed in a side. The groove 120 can extend substantially along the length of the post 110. For example, the groove 120 can extend from a base securable to a surface, through an upper portion that receives the panels, to a top of the post. The groove 120 can be sized to receive an edge of a decorative wall panel 10. In one aspect, the groove 120 can be approximately 2 to 3 inches wide and approximately 1 to 3 inches deep. In another aspect, the groove 120 can be open to a top end of the post 110, and can extend toward a lower end of the post, but is not open to a bottom end of the post 110. Thus, in use, when the post 110 is placed in a hole, the groove 120 can extend into the hole. In this way, when concrete is placed in the hole to secure the post 110, the concrete can flow into and fill the groove 120, thereby anchoring the post 110 into the concrete and restricting axial displacement of the post 110 out of the concrete and hole. Additionally, apertures in the bottom of the post 110 formed by the fabrication process of the post 110 can allow concrete to flow into the post 110 itself, and provide additional anchoring forces and weight to the post.

The posts 110 can also have a plurality of longitudinal vertical grooves 120 to accommodate different positions in the fence system 100. In one aspect, the post 110 can be an end post 110*a* with only one longitudinal vertical groove 120. In another aspect, the post 110*b* can join two decorative fence panels 10 to form a substantially straight fence line and can have two longitudinal grooves 120 on opposite sides. In yet another aspect, the post 110 can be a corner post 110*c* joining two decorative fence panels 10 at an approximate right angle, and can have two longitudinal grooves 120 on adjacent sides. In still another aspect the post 110 can join three decorative fence panels 10, and can have three longitudinal grooves 120, on three adjacent sides. Additionally, the post can join four fence panels, and can have four longitudinal grooves 120, with one groove on each side of the post. It will be appreciated that although the grooves 120 are shown in the figures as being oriented generally at right angles to one another, the grooves can also be formed at oblique angles to one another to accommodate fences with corners of various angles, such as fences along non-uniform property lines.

Each post 110 can also include a reinforcing insert 130 extending axially along, or adjacent to the longitudinal axis of the post and disposed between the vertical grooves 120, as shown in FIG. 10. The reinforcing insert 130 can stiffen and strengthen the post 110.

Some aspects of molding or forming a polymeric resin article about a rigid elongated member are described in U.S. patent application Ser. Nos. 11/009,186 and 11/003,709, which are incorporated herein by reference in their entirety for all purposes. Shrinkage of a molded article about an elongate frame member, such as the reinforcing insert 130, during a plastic molding process can cause crushing and consequent deformation and damage (e.g. crushing) to core material in a shrinkage region adjacent to the end of the frame member. Thus, the reinforcing insert 130 can be an adhesion resistant reinforcing member as described in U.S. patent application Ser. No. 11/009,186, and/or a cavity or void can be formed around the end of the reinforcing insert 130 to provide a slip zone or crush zone around the end of the reinforcing member as described in U.S. patent application Ser. No. 11/003,709. Advantageously, adhesion resistance and crush zone cavities reduce the stresses on the end of the reinforcing member caused by post-molding shrinkage and thermal contraction of the polymer material. Reducing the stresses on the reinforcing inserts 130 can reduce deformation and damage to filler material and improve the shape and appearance of the molded posts 110.

The plurality of decorative fence panels 10 can be similar to the fence panel 10 described above and shown in FIGS. 1-4, and can be disposed between adjacent posts 110. Each decorative fence panel 10 can have a lateral peripheral edge 52 or lateral edge that can be at least partially disposed within the vertical grooves 120 of the adjacent posts 110. The decorative fence panel 10 can be retained in the vertical grooves by gravity alone, and does not require mechanical fasteners to secure the panel 10 to the post 110 (although mechanical fasteners can be utilized in certain circumstances). The vertical grooves 120 in the posts 110 can restrict displacement of the decorative panel to an axial plane of the adjacent posts, shown by dashed lines at 140 in FIG. 8. A gap 150 (FIG. 10) can be located between the bottom 122 of the vertical groove 120 and the decorative panel 10, or lateral sides of the walls, to accommodate thermal expansion of the decorative panel 10. Thus, the decorative fence panel 10 is capable of thermal expansion into and along the groove 120.

Advantageously, because the panels are light weight, repair and replacement of broken or damaged panels can be done quickly and easily. For example, if a panel 10 is broken, it can be replaced simply by lifting the broken panel out of the vertical grooves 120 and inserting a new panel 10 into the vertical grooves 120. In this way, a damaged fence can be repaired in a very short amount of time. Additionally, because of the polymeric resin, the outermost dimensions of the decorative fence panel are never bigger than the width of the vertical grooves. Thus, the panels can be cut to fit within a fencing section without affecting any physical properties such as strength, stiffness, rigidity, or heat transfer properties, of the panel.

Referring to FIG. 10, the elongated insert 50*a* can extend longitudinally along a top 54 of the decorative fence panel 10 between the opposite walls 20*a* and 20*b*. Additionally, the elongated insert 50*b* can extend longitudinally along a bottom 58 of the decorative panel 10 between the opposite walls 20*a* and 20*b* (see FIG. 4). In one aspect, the elongated inserts 50*a* and 50*b* can have opposite ends 56 that extend beyond the lateral peripheral edge, or perimeter 52 of the decorative panel 10, or lateral sides of the walls 20*a* and 20*b*. In another aspect, the elongated inserts 50 can be longer than the distance from a bottom 122 of a vertical groove 120 in one post 110 to a top of a facing vertical groove 120 in an adjacent post 110. In another aspect, the elongated inserts can be substantially as long as the distance between the bottoms of facing vertical grooves of adjacent posts. Thus, when a decorative panel 10 is slid between two adjacent posts 110, the elongated inserts 50*a* and 50*b* can engage the vertical grooves 120 in a zero clearance fit between the vertical grooves 120 of the two adjacent posts 110, and at the same time, leave room for the decorative panel 10 to expand or shrink from thermal expansion without interference from the posts 110.

Additional hardware can be used to facilitate installation of the fencing system 100. For example, a bracket can be secured in the groove near the bottom of the post 110 to position the elongated insert 50*b* in an axial position along the axis of the post 110. In this way, the decorative fence panel 10 can hang from the elongated inserts 50 between two posts 110. Thus, the decorative fence panel 10 is not constrained by the posts 110 or the elongated inserts 50*a* and 50*b* so that the decorative fence panel 10 can thermally expand and contract when hanging from the elongated inserts.

It will be appreciated that additional fence components, such as personnel gates, vehicle gates, and security gates can also be formed in accordance with the principles and technology of the present invention. For example, a personnel gate can be formed similarly to a decorative fence panel 10 and the gate can have a simulated decorative profile similar to adjacent fencing. In one aspect, a gate can conform to the height and decorative profile of the fence, thus maintaining the appearance of the fence, in order to conceal or blend the gate into the surrounding fence. In another aspect the gate can be defined by a molded border, or other offsetting features, as known in the art, so that the gate can be easily seen and accessed. Advantageously, the light weight of the polymeric resin can make the gate very light and easy to move, and the strength and rigidity of the plurality of nodes can make the gate very strong and durable. Thus, gates made from the present invention can be very large and yet easy to move. In this way, an entire fence can be fabricated and installed using the concepts of the present invention.

Turning now to FIGS. 11-14, a method for installing the fencing system 100 described above and illustrated in FIGS. 8-10, is shown. The method for installing the fencing system 100 includes securing a plurality of posts 110 having at least one vertical groove 120 to a support surface. For example, bottom ends of the posts can be buried in the ground, or in concrete. Alternatively, they may be bolted or otherwise fastened to decking or concrete pads. Elongated reinforcing inserts 50*a* and 50*b* can be slid into the top 54 and the bottom 58 of the decorative fence panel 10.

The decorative fence panel 10 can be slid into the vertical grooves 120 from openings near upper ends of the adjacent posts 110. The elongated reinforcing inserts 50*a* and 50*b* can engage the vertical grooves 120 to secure the decorative fence panel 10 between the adjacent posts 110. End caps 160 can be placed on the posts 110 after the decorative panel 10 is slid into the vertical grooves 120 of the adjacent posts 110. As described above, the posts can be spaced apart to accommodate the size of the panels, but the panels can also be cut to fit between adjacent posts.

Figure 15:
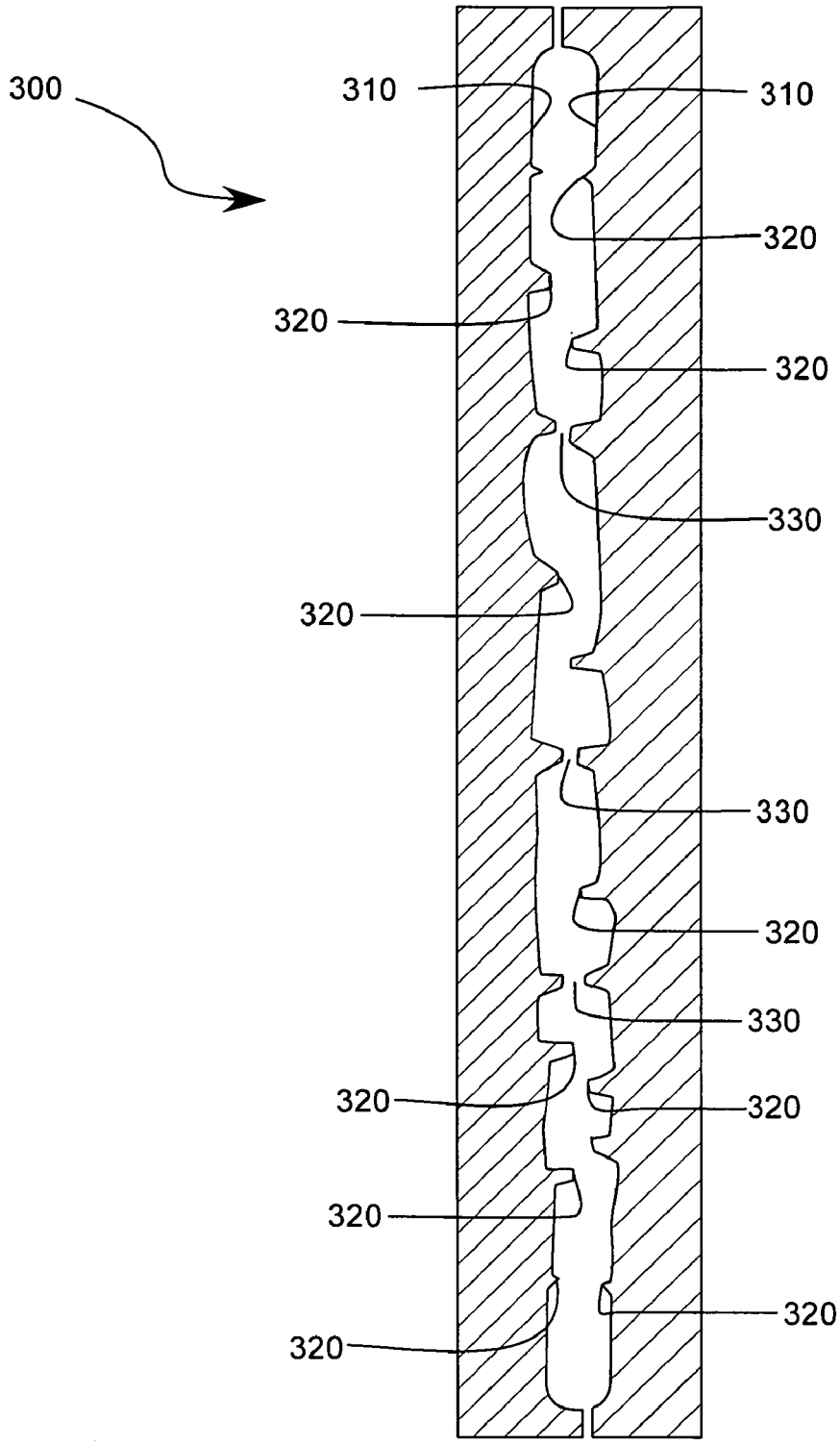
FIG. 15 is a cross section view of a mold for forming the decorative fence panel of FIG. 1.
Figure 16:
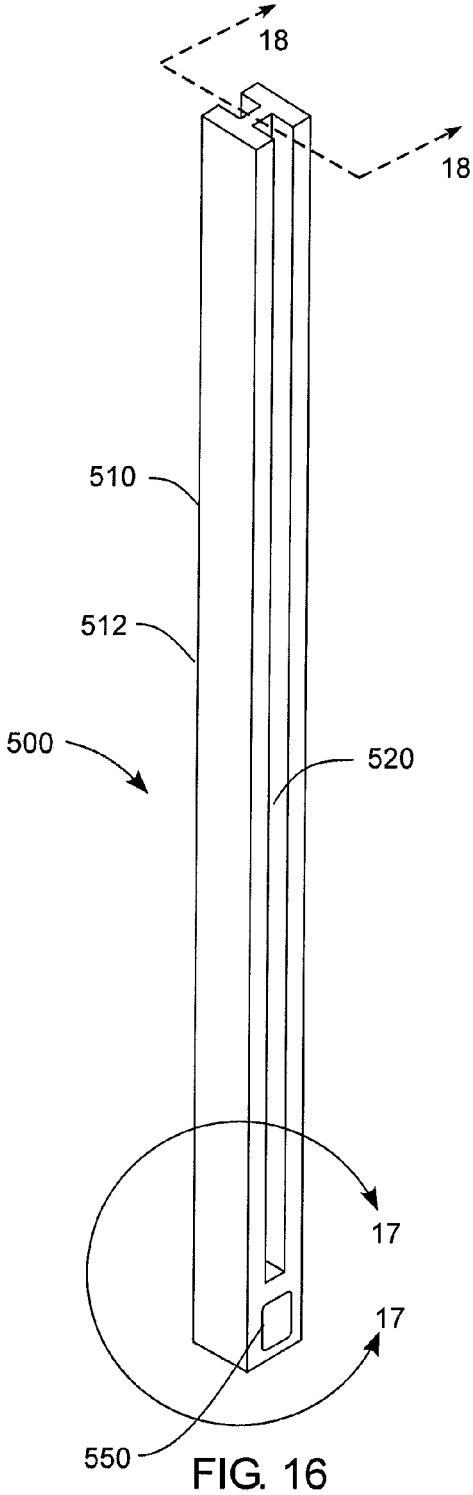
FIG. 16 is a perspective view of a decorative fence post in accordance with another embodiment of the present invention.
Figure 17:
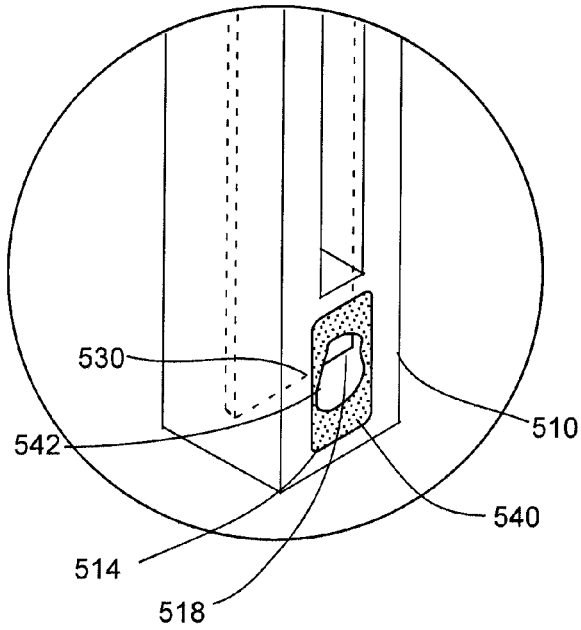
FIG. 17 is a partial cut-away view of a bottom end of the decorative fence post of FIG. 16.
Figure 18:
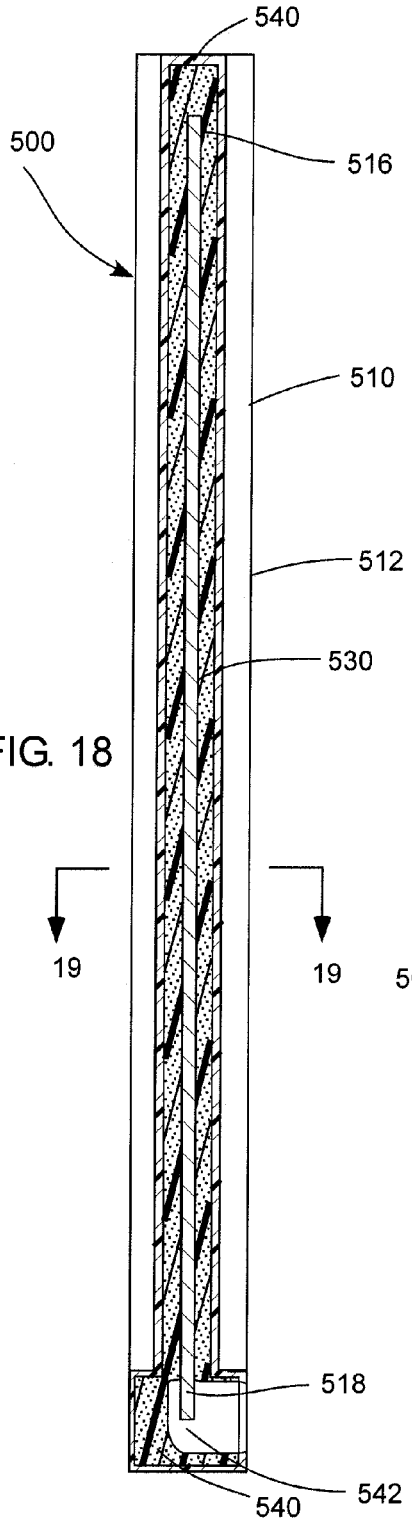
FIG. 18 is a side view of the decorative fence post of FIG. 16.
Figure 19:
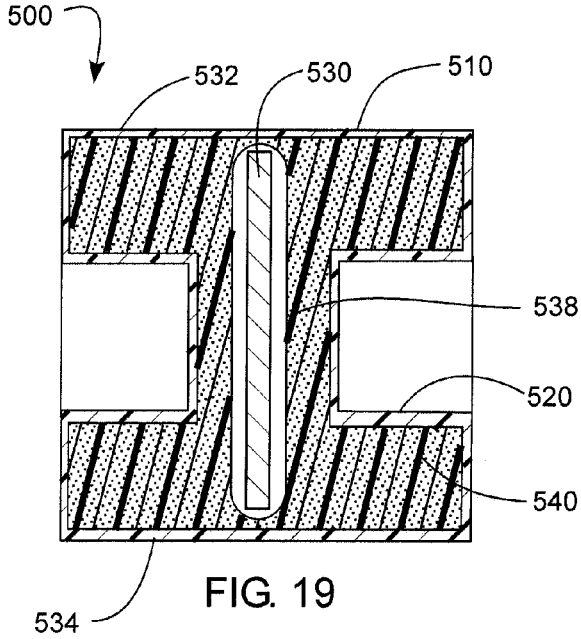
FIG. 19 is a cut-away top view of the decorative fence post of FIG. 16.

Turning to FIG. 15, the present invention also provides for a method of making a decorative fence panel 10 including providing a mold 300 having opposing mold surfaces 310 with a grid of traversing protrusions 320 formed on each mold surface 310. The protrusions 320 can extend towards the opposing mold surface 310, and define an inverse decorative profile of a fence. The protrusions 320 also form a plurality of select gaps 330 between the grids of transverse protrusions 320. A moldable plastic material can be introduced into the mold.

The plastic material can be molded by a molding process to form a decorative fence panel. The molding process can form opposite plastic walls with opposite facing exterior surfaces having a grid of traversing channels indenting in towards the opposite wall to define a decorative profile of a fence. The plurality of gaps 330 between the grids of traversing protrusions 320 can form a plurality of separate and discrete connections between the grids of traversing channels of the opposite walls. The gaps 330 can have a separation distance approximately twice the thickness of the opposite plastic walls. The separate and discrete connections can form a plurality of continuous material nodes between the opposite walls The molding process can be rotational molding, blow molding, injection molding, gas assist injection molding, water assisted injection molding, vacuum molding, compression molding, pultrusion or combinations of these processes, as known in the art. In another aspect, the decorative fence panel can be formed by a plastic forming process such as thermoforming, twin sheet thermoforming, extrusion forming, and combinations thereof.

The present invention also provides for a method of making a decorative post 110 including providing a mold having opposing mold surfaces defining an inverse decorative profile of a post. A moldable plastic material can be introduced into the mold. The plastic material can be molded by a molding process to form a decorative post. The molding process can form continuous plastic walls. The molding process can be rotational molding, blow molding, injection molding, gas assist injection molding, water assisted injection molding, vacuum molding, compression molding, pultrusion or combinations of these processes, as known in the art. In another aspect, the decorative posts can be formed by a plastic forming process such as thermoforming, twin sheet thermoforming, extrusion forming, and combinations thereof. In addition, an insert can be disposed in the mold so that the plastic material surrounds the insert. Furthermore, a foaming agent can be introduced into the mold, such as by a drop box, to form a foam between the insert and the plastic walls.

As illustrated in FIGS. 16-20, a decorative fence post, indicated generally at 500, is shown in accordance with another embodiment of the present invention for use with a decorative fence panel 10 as described above, and shown in FIGS. 1-15. The decorative fence post 500 can be similar in many respects to the fence post 110 described above and shown in FIGS. 1-15. Additionally, the decorative fence post 500 can have an elongated outer polymer shell 510, an elongated reinforcing member 530, and foam filler 540 disposed inside the outer shell and between the outer shell and the reinforcing member.

The outer shell 510 can include a polymeric or plastic wall continuously formed around at least a radial perimeter 512 of the fence post 500. The outer shell 510 can also have at least one longitudinal groove 520 that can extend a majority of a length of the elongated outer shell. The longitudinal groove 520 can be sized and shaped to hold a decorative fence panel 10. The longitudinal groove 520 of the outer shell 510 can give the radial perimeter 512 a cross section shaped like a capital "H".

The elongated reinforcing member 530 can be disposed within the outer shell 510, and can substantially extend a length of the decorative fence post 500. Additionally, in one aspect, the elongated reinforcing member 530 can extend from one side 532 of the perimeter 512 of the outer shell to an opposite side 534 of the perimeter, as shown in FIG. 10.

Figure 20:
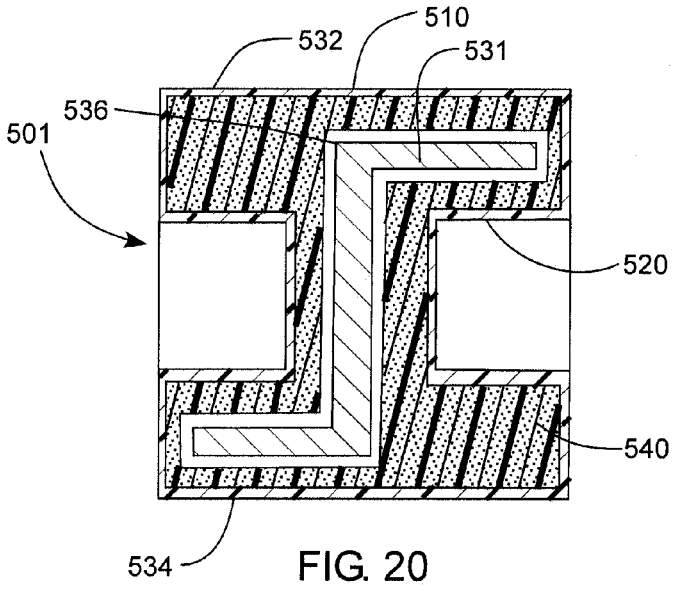
FIG. 20 is a cut-away top view of a decorative fence post in accordance with another embodiment of the present invention.

The elongated reinforcing member 530 can be formed from metal, plastic, wood or composite material, and can be shaped to support applied loads from fence panels 10 supported by the longitudinal grooves 520. For example, the elongated reinforcing member 530 can be formed from aluminum and can have at least one bend or fold 536 along a longitudinal length of the reinforcing member 530 that can increase the rigidity of the reinforcing member, as shown in FIG. 20. Additionally, the elongated reinforcing member 530 can be formed from a material, or coated with a material that can keep the reinforcing member substantially free from chemical or mechanical adhesion or bonding with the foam filler, as described in U.S. patent application Ser. No. 11/003,709 filed on Dec. 3, 2004, which is herein incorporated by reference in its entirety for all purposes.

It will be appreciated that the polymer decorative fence post 500 is likely to have a higher coefficient of thermal expansion than the reinforcing member 530. Thus, the outer shell 510 and foam filler 540 of the fence post 500 can shrink more than the reinforcing member 530 as the decorative fence post 500 cools after molding. If the foam filler material 540 is bonded to the reinforcing member 530, a significant additional shrinkage stress can be induced in the outer shell 510 and filler material 540, and thus more warping of the post cured fence post 500 can occur. However, if the reinforcing member 530 is substantially free from adhesion or bonding to the foam filler material 540, then the foam filler material can "slide" along the reinforcing member as the foam filler material shrinks. Thus, only a small, localized region of foam filler material 540 directly adjacent to a surface 538 of the reinforcing member 530 may be deformed or crushed due to shrinkage, and significant additional warping and deformation of the fence post 500 can be reduced.

Accordingly, a non-stick coating can be applied to the reinforcing member 530 to reduce bonding of the foam filler material to the reinforcing member. For example, a mold release agent can be applied to a rolled steel elongate reinforcing member to prevent adhesion of the polymer material of the filler material to the elongate reinforcing member. This type of coating adheres strongly to the material of the reinforcing member, is not affected by the high temperatures of the rotational molding process, is inexpensive, easy to apply, and is readily commercially available.

Other non-stick coatings or treatments can also be used, such as fluoropolymer resins and films, graphite, wax, zinc or magnesium stearate, silicon, silicon derivatives, and the like. It will be apparent that an appropriate non-stick agent will depend on the material of the reinforcing member 530 and the particular polymers used in the molded fence post 500. For example, a wood reinforcing member can also be used when wrapped with fluoropolymer film (e.g. about 3 mils thick). Thus, the reinforcing member 530 of the present invention advantageously does not adhere to the foam filler material 540, but is nevertheless fully encased within the foam filler so that full structural interaction is maintained between the reinforcing member 530 and the molded fence post 500.

The foam filler 540 can be disposed inside the outer polymer shell 510. The foam filler 540 can fill the outer polymer shell 510 between the shell and the reinforcement member 530. The outer shell 510 and the foam filler 540 can be integrally formed from a common polymer material in a single rotational molding process as described in U.S. patent application Ser. No. 10/464,622, filed on Jun. 18, 2003, which is herein incorporated by reference in its entirety for all purposes. Thus, the fence post 500 described herein uses a combination of a foam filler 540 to form a foam core encapsulated within a polymer outer shell 510 having one or more layers in order to produce a laminate polymeric fence post 500 that is very strong and has high impact resistance.

Advantageously, the foam filler 540 and polymer skin of the outer shell 510 may be of the same species of material, simply in different forms or densities (i.e. foam vs. higher density skin), thereby providing an integral transition from the skin of the outer shell 510 to the foam filler material 540. This integral transition drastically reduces the possibility of delamination between the various laminate layers of the fence post 500 of the present invention. Additionally, the unique concurrently molded polymer outer shell 510 and foam filler 540 system produces a solid post 500 that can resist crushing and also inhibits ultraviolet degradation.

Many different kinds of foam materials may be used as the foam filler material. For example, olefinic foams have been used and are substantially less expensive than injected foams, such as polyurethane isofoam. Thus, the present invention allows less expensive foam materials to be used for lightweight fence post cores which could not be used before. Olefinic foams also produce far less fluid pressure (~5 psi) than injected foams (which produce ~40-50 psi), thus allowing their use in relatively lightweight and less expensive rotational molds. The "blowing" or foaming reaction of sodium bicarbonate-based foams is an endothermic reaction. It will be appreciated that the use of an endothermic foaming agent can make temperature control easier during the rotational molding process. However, exothermic foaming agents can also be used in accordance with the method of this invention.

Thus, the present invention advantageously allows for two similar or dissimilar materials to be used for the outer shell polymer and the foam filler polymer, and forms a laminate structure which becomes integrally connected into a strong mass. The unexpanded material of the shell can gradually transition into the expanded foam material of the core, such that there is no distinguishably distinct interface between the outer shell and the foam filler. Because the outer shell material and foam filler material are placed and cured together in a single step rotational molding process, the outer shell and foam filler may be the very same type of material, and the transition from one to the other primarily represents a change in density, rather than an interface between two materials. Consequently, the fence post 500 of the present invention does not have a weakened interface between the outer shell 510 and the foam filler 540, thus greatly reducing the problem of delamination of the outer shell 510 from the foam filler 540, even when subjected to heat and other stress.

The outer polymer shell 510 can include at least one aperture 514 near the end 518 of the reinforcing member 530 disposed within the outer polymer shell 510. In one aspect, the aperture 514 can be a hole through the outer shell 510 located near a bottom end 518 of the fence post 500. A void 542 can extend from the aperture 514 into the foam filler 540 adjacent to and exposing the end 518 of the reinforcing member 530.

The void 542 can define slip zones 544 in the decorative fence post 500 at the end 518 of the reinforcing member 530. Such slip zones are described in U.S. patent application Ser. No. 11/009,186, filed Dec. 12, 2004 which is herein incorporated by reference in its entirety for all purposes. The bottom end 518 of the reinforcing member 530 can extend into the slip zone 544 so that as the outer shell 510 and foam filler 540 shrink longitudinally during post mold cooling the outer shell and foam filler will not warp or deform due to stresses induced by the reinforcing member 530. Thus, the slip zone 544 can have substantially no contact between the foam filler 540 and a longitudinal length or end 518 of the elongated reinforcing member 530 extending into the slip zone 544. In this way, the slip zone 544 can allow for post-formation shrinkage of the outer shell 510 and foam filler 540 so that substantially no stress is imposed on the end 518 of the elongated reinforcing member 530.

It will be appreciated that an elongate reinforcing member 530 encased in a foam filler 540 can result in warping or deformation of the decorative fence post because shrinkage of the molded fence post relative to the reinforcing member can tend to cause crushing and consequent deformation and damage (e.g. crushing) to the foam filler material in a shrinkage region adjacent to the end 518 of the reinforcing member 530. Advantageously, the present invention provides for an end mount or plug (not shown) that can be placed into the mold (not shown) in order to create the aperture 514 in the outer shell 510 and the cavity or void 542 in the foam filler 540 around the end 518 of the elongate reinforcing member 530. As discussed above, this void 542 defines the crush zone or slip zone around the end 518 of the reinforcing member 530, such that post-molding shrinkage and thermal contraction of the polymer material of the outer shell 510 and foam filler material 540 imposes substantially no stress on the end of the reinforcing member 530. Thus, the foam filler 540 can contact only a portion of the sides of the reinforcing member 530, and post-molding shrinkage of the foam filler 540 thus imposes substantially no stress on the ends of the reinforcing member 530. A pad or cap 550, made of resilient material, such as rubber or rubber-like material, can be provided as a cover to plug the aperture 514 on the finished fence post 500, for a better appearance.

Figure 21:
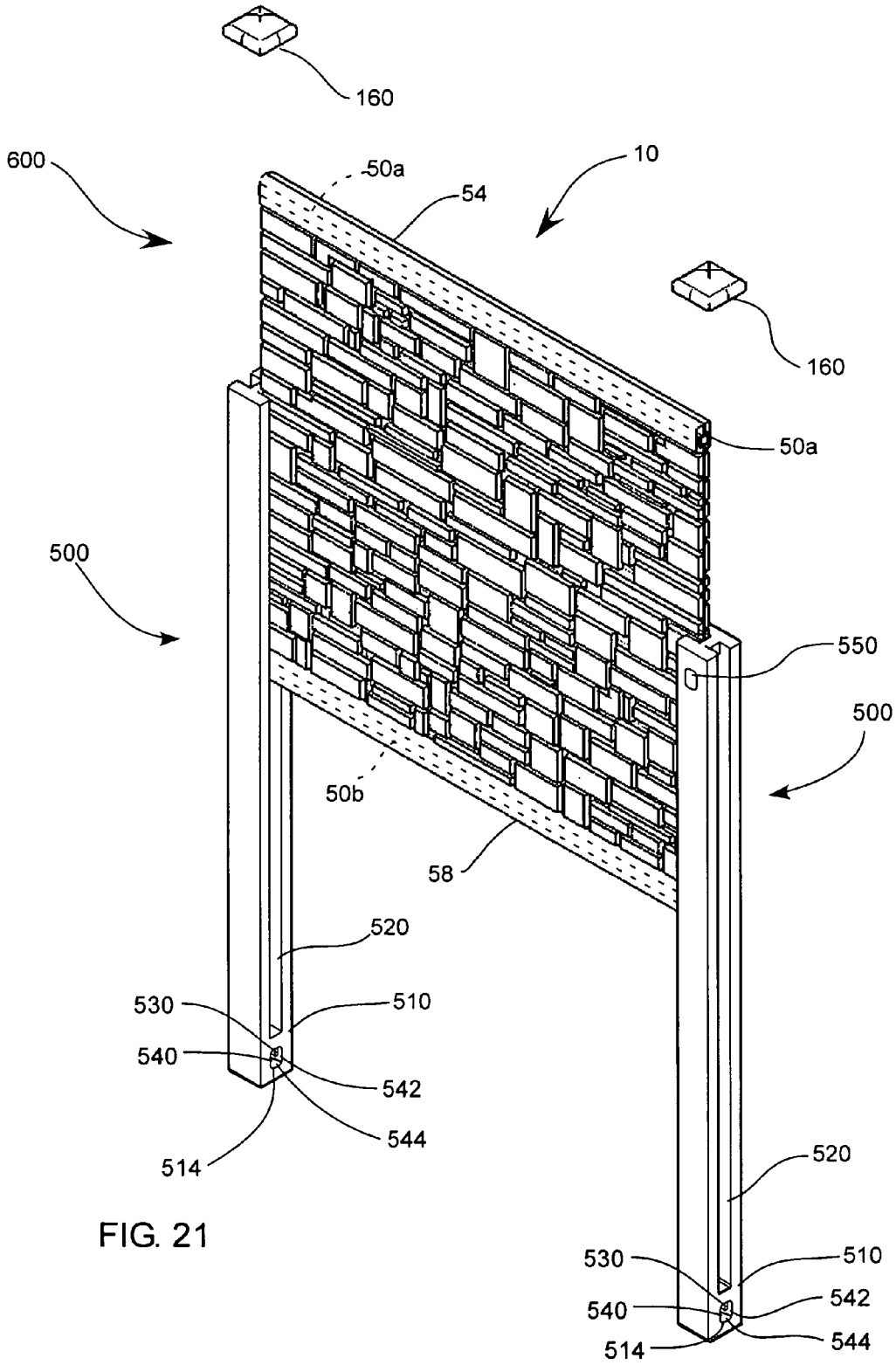
FIG. 21 is a perspective view of section of a fence in accordance with another embodiment of the present invention.

As illustrated in FIG. 21, a decorative fence, 600, is shown in accordance with another embodiment of the present invention. The decorative fence 600 can include a decorative fence post 500 as described above and shown in FIGS. 16-20, and a decorative fence panel 10, described above and shown in FIGS. 1-15.

Thus, the decorative fence 600 can include a plurality of decorative fence panels 10 and a plurality of decorative fence posts 500. Each fence post 500 can have at least one groove 520 sized and shaped to support an end 52 of the fence panels. Thus, each fence post 500 can be disposed adjacent an end 52 of at least one of the plurality of fence panels 10, and the end 52 of the fence panel 10 can be disposed in the groove 520.

Additionally, each decorative fence post 500 can have an elongated outer polymer shell 510 with an elongated reinforcing member 530 inside the shell and a foam filler 540 filling the space in the outer shell between the outer shell and the reinforcing member. Each post 500 can also have an aperture 514 disposed in the outer polymer shell 510 near an end of the reinforcing member 530, and a void 542 extending from the aperture into the foam filler 540 adjacent to and exposing an end of the reinforcing member. The void 542 can define a slip zone at the end of the reinforcing member 530 that has substantially no contact between the foam filler and a longitudinal length of the end of the elongated reinforcing member in order to allow for post-formation shrinkage of the outer shell and foam filler. In this way, each post 500 of the fence 600 can be substantially free from warping and deformation due to post mold curing shrinkage effects, and also warping due to temperature changes in the environment in which the fence post 500 is installed.

The present invention also provides for a method for making a fence post including placing an elongate reinforcing member in a mold. An outer polymer shell can be formed around the elongate reinforcing member in the mold. The mold can form at least one longitudinal groove in the outer shell that can hold a section of fence, or an end of a decorative fence panel. The mold can also form an aperture in a lower end of the outer shell corresponding to an end of the elongate reinforcing member. The outer polymer shell can be filled with a foam filler material that can substantially surround the elongate reinforcing member. A void can be formed in the foam core between the aperture in the outer polymer shell and the end of the elongate reinforcing member to define a slip zone around the end of the elongate reinforcing member.

In one aspect, the void can be formed by a plug that can be placed in the mold prior to adding the foam filler material. The plug can be removed during cooling of the mold.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A decorative post configured to be disposed in a support surface to support a decorative fence or wall panel, comprising:

a) an elongated outer polymer shell having at least two opposite longitudinal grooves extending a majority of a longitudinal length of the elongated shell and configured to hold a fence panel;

b) an elongated reinforcing member disposed in the outer polymer shell between the longitudinal grooves, and substantially extending a length of the outer polymer shell;

c) a foam filler disposed inside the outer polymer shell between the shell and the reinforcement member;

d) an aperture disposed in a sidewall of the outer polymer shell near an end of the reinforcing member; and e) a void in the foam filler adjacent to and exposing the end of the reinforcing member through the aperture, and defining a slip zone between the end of the reinforcement member and an inner surface of the foam filler defined by the void into which the end of the reinforcing member extends as the outer shell shrinks longitudinally during post mold cooling.

2. A post in accordance with claim 1, wherein the elongated outer shell and the foam filler are integrally formed from a common polymer material in a single rotational molding process.

3. A post in accordance with claim 1, wherein the slip zone is sized and shaped to allow for post-formation shrinkage of the outer shell and the foam filler such that substantially no stress is imposed on the end of the elongated reinforcing member.

4. A post in accordance with claim 1, wherein the slip zone has substantially no contact between the foam filler and a longitudinal length of the elongated reinforcing member in the slip zone.

5. A post in accordance with claim 1, wherein a surface of the elongated reinforcing member is substantially free from chemical or mechanical adhesion with the foam filler.

6. A post in accordance with claim 1, wherein the outer polymer shell includes a plastic wall continuously formed around at least a radial perimeter of the post.

7. A post in accordance with claim 6, wherein the elongated reinforcing member being disposed in the foam filler from one side of the perimeter to an opposite side of the perimeter.

* * * * *